US008567532B2

(12) United States Patent
Hall et al.

(10) Patent No.: US 8,567,532 B2
(45) Date of Patent: Oct. 29, 2013

(54) CUTTING ELEMENT ATTACHED TO DOWNHOLE FIXED BLADED BIT AT A POSITIVE RAKE ANGLE

(75) Inventors: David R. Hall, Provo, UT (US); Ronald B. Crockett, Houston, TX (US); Marcus Skeem, Sandy, UT (US); Francis Leany, Salem, UT (US); Casey Webb, Spanish Fork, UT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 280 days.

(21) Appl. No.: 12/619,305

(22) Filed: Nov. 16, 2009

(65) Prior Publication Data

US 2010/0059288 A1 Mar. 11, 2010

Related U.S. Application Data

(63) Continuation-in-part of application No. 11/774,227, filed on Jul. 6, 2007, now Pat. No. 7,669,938, which is a continuation-in-part of application No. 11/773,271, filed on Jul. 3, 2007, now Pat. No. 7,997,661, which is a continuation-in-part of application No. 11/766,975, filed on Jun. 22, 2007, now Pat. No. 8,122,980, which is a continuation-in-part of application No. 11/766,903, filed on Jun. 22, 2007, which is a continuation-in-part of application No. 11/766,865, filed on Jun. 22, 2007, now abandoned, which is a (Continued)

(51) Int. Cl.
*E21B 10/43* (2006.01)

(52) U.S. Cl.
USPC ..... 175/428

(58) Field of Classification Search
USPC ..... 175/428
See application file for complete search history.

(56) References Cited

U.S. PATENT DOCUMENTS 4,315 A 12/1845 Hemming
37,223 A 12/1862 Fosdick (Continued)

FOREIGN PATENT DOCUMENTS

DE 3307910 9/1984
DE 3500261 7/1986

(Continued)

OTHER PUBLICATIONS

SME Mining Engineering Handbook, Hartman, 1992 pp. 680, 681, 684-692.*

US Department of Energy, Geothermal Drilling Faster and Cheaper is Better, Geothermal Today, May 2000, p. 28, National Renewable Energy Laboratory Golden, Colorado.

(Continued)

*Primary Examiner* — John Kreck
(74) *Attorney, Agent, or Firm* — Osha Liang LLP

(57) ABSTRACT

A downhole fixed bladed bit comprises a working surface comprising a plurality of blades converging at a center of the working surface and diverging towards a gauge of the bit, at least on blade comprising a cutting element comprising a superhard material bonded to a cemented metal carbide substrate at a non-planer interface, the cutting element being positioned at a positive rake angle, and the superhard material comprising a substantially conical geometry with an apex comprising a curvature.

20 Claims, 17 Drawing Sheets

Related U.S. Application Data continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770, which is a continuation-in-part of application No. 11/673,634, filed on Feb. 12, 2007, now Pat. No. 8,109,349, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256.

(56) References Cited

U.S. PATENT DOCUMENTS 465,103 A 12/1891 Wegner
616,118 A 12/1898 Kunhe
946,060 A 1/1910 Looker
1,116,154 A 11/1914 Stowers
1,183,630 A 5/1916 Bryson
1,189,560 A 7/1916 Gondos
1,360,908 A 11/1920 Everson
1,367,733 A 6/1921 Midgett
1,460,671 A 7/1923 Habsacker
1,544,757 A 7/1925 Hufford
1,821,474 A 9/1931 Mercer
1,879,177 A 9/1932 Gault
2,004,315 A 6/1935 Fean
2,124,436 A 7/1936 Struk
2,124,438 A 7/1936 Struk
2,121,202 A 6/1938 Killgore
2,054,255 A 9/1938 Howard
2,064,255 A 12/1938 Garfield
2,169,223 A 8/1939 Christian
2,218,130 A 10/1940 Court
2,320,136 A 5/1943 Kammerer
2,466,991 A 4/1949 Kammerer
2,540,464 A 2/1951 Stokes
2,544,036 A 3/1951 Kammerer
2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter
3,254,392 A 6/1966 Novkov
3,294,186 A 12/1966 Buell
3,301,339 A 1/1967 Pennebaker, Jr.
3,379,264 A 4/1968 Cox
3,397,012 A 8/1968 Krekeler
3,429,390 A 2/1969 Bennett
3,493,165 A 2/1970 Schofield
3,583,504 A 6/1971 Aalund
3,626,775 A 12/1971 Gentry
3,745,623 A 7/1973 Wentorf et al.
3,746,396 A 7/1973 Radd
3,764,493 A 10/1973 Rosar
3,800,891 A 4/1974 White et al.
3,807,804 A 4/1974 Kniff
3,821,993 A 7/1974 Kniff
3,830,321 A 8/1974 McKenry et al.
3,932,952 A 1/1976 Helton
3,945,681 A 3/1976 White
3,955,635 A 5/1976 Skidmore
3,960,223 A 6/1976 Kleine
4,005,914 A 2/1977 Newman
4,006,936 A 2/1977 Crabiel
4,081,042 A 3/1978 Johnson
4,096,917 A 6/1978 Harris
4,098,362 A 7/1978 Bonnice
4,106,577 A 8/1978 Summer
4,109,737 A 8/1978 Bovenkerk
4,140,004 A 2/1979 Smith et al.
4,156,329 A 5/1979 Daniels
4,176,723 A 12/1979 Arceneaux
4,199,035 A 4/1980 Thompson
4,201,421 A 5/1980 Den Besten
4,211,508 A 7/1980 Dill et al.
4,224,380 A 9/1980 Bovenkerk et al.
4,253,533 A 3/1981 Baker
4,268,089 A 5/1981 Spence et al.
4,277,106 A 7/1981 Sahley
4,280,573 A 7/1981 Sudnishnikov
4,304,312 A 12/1981 Larsson
4,307,786 A 12/1981 Evans
D264,217 S 5/1982 Prause et al.
4,333,902 A 6/1982 Hara
4,333,986 A 6/1982 Tsuji
4,337,980 A 7/1982 Krekeler
4,390,992 A 6/1983 Judd
4,397,361 A 8/1983 Langford
4,412,980 A 11/1983 Tsuji
4,416,339 A 11/1983 Baker
4,425,315 A 1/1984 Tsuji
4,439,250 A 3/1984 Acharya
4,445,580 A 5/1984 Sahley
4,448,269 A 5/1984 Ishikawa
4,465,221 A 8/1984 Schmidt
4,481,016 A 11/1984 Campbell et al.
4,484,644 A 11/1984 Cook
4,484,783 A 11/1984 Emmerich
4,489,986 A 12/1984 Dziak
4,499,795 A 2/1985 Radtke
4,525,178 A 6/1985 Hall
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,599,731 A 7/1986 Ware et al.
4,604,106 A 8/1986 Hall
4,627,503 A 12/1986 Horton
4,636,253 A 1/1987 Nakai et al.
4,636,353 A 1/1987 Seon
4,640,374 A 2/1987 Dennis
4,647,111 A 3/1987 Bronder et al.
4,647,546 A 3/1987 Hall, Jr. et al.
4,650,776 A 3/1987 Cerceau et al.
4,662,348 A 5/1987 Hall et al.
4,664,705 A 5/1987 Horton et al.
4,678,237 A 7/1987 Collin
4,682,987 A 7/1987 Brady et al.
4,684,176 A 8/1987 Den Besten et al.
4,688,856 A 8/1987 Elfgen
4,690,691 A 9/1987 Komanduri
4,694,918 A 9/1987 Hall
4,725,098 A 2/1988 Beach
4,726,718 A 2/1988 Meskin et al.
4,729,440 A 3/1988 Hall
4,729,441 A 3/1988 Peetz et al.
4,729,603 A 3/1988 Elfgen
4,765,419 A 8/1988 Scholz et al.
4,765,686 A 8/1988 Adams
4,765,687 A 8/1988 Parrott
4,776,662 A 10/1988 Ward
4,776,862 A 10/1988 Wiand
4,815,342 A 3/1989 Brett et al.

(56) References Cited

U.S. PATENT DOCUMENTS 4,815,345 A 3/1989 Radice
4,852,672 A 8/1989 Behrens
4,880,154 A 11/1989 Tank
4,889,017 A 12/1989 Fuller
D305,871 S 2/1990 Geiger
4,921,310 A 5/1990 Hedlund et al.
4,932,723 A 6/1990 Mills
4,940,099 A 7/1990 Deane et al.
4,940,288 A 7/1990 Stiffler
4,944,559 A 7/1990 Sionnet
4,944,772 A 7/1990 Cho
4,951,762 A 8/1990 Lundell
4,956,238 A 9/1990 Griffin
4,962,822 A 10/1990 Pascale
4,981,184 A * 1/1991 Knowlton et al. ..... 175/429
5,007,685 A 4/1991 Beach et al.
5,009,273 A 4/1991 Grabinski
5,011,515 A 4/1991 Frushour
5,027,914 A 7/1991 Wilson
5,038,873 A 8/1991 Jurgens
D324,056 S 2/1992 Frazee
D324,226 S 2/1992 Frazee
5,088,797 A 2/1992 O'Neill
5,112,165 A 5/1992 Hedlund
5,119,714 A 6/1992 Scott et al.
5,119,892 A 6/1992 Clegg
5,141,063 A 8/1992 Quesenbury
5,141,289 A 8/1992 Stiffler
D329,809 S 9/1992 Bloomfield
5,154,245 A 10/1992 Waldenstrom
5,186,268 A 2/1993 Clegg
5,186,892 A 2/1993 Pope
5,222,566 A 6/1993 Taylor
5,248,006 A 9/1993 Scott et al.
5,251,964 A 10/1993 Ojanen
5,255,749 A 10/1993 Bumpurs
5,261,499 A 11/1993 Grubb
5,265,682 A 11/1993 Russell
D342,268 S 12/1993 Meyer
5,303,984 A 4/1994 Ojanen
5,304,342 A 4/1994 Hall, Jr. et al.
5,332,051 A * 7/1994 Knowlton ..... 175/430
5,332,348 A 7/1994 Lemelson
5,351,770 A 10/1994 Cawthorne et al.
5,361,859 A 11/1994 Tibbitts
5,374,319 A 12/1994 Stueber et al.
D357,485 S 4/1995 Mattsson et al.
5,410,303 A 4/1995 Comeau
5,417,292 A 5/1995 Polakoff
5,417,475 A 5/1995 Graham
5,423,389 A 6/1995 Warren
5,447,208 A 9/1995 Lund
5,494,477 A 2/1996 Flood et al.
5,507,357 A 4/1996 Hult
D371,374 S 7/1996 Fischer et al.
5,533,582 A 7/1996 Tibbitts
5,535,839 A 7/1996 Brady
5,542,993 A 8/1996 Rabinkin
5,544,713 A 8/1996 Dennis
5,560,440 A 10/1996 Tibbitts
5,568,838 A 10/1996 Struthers
5,653,300 A 8/1997 Lund
5,655,614 A 8/1997 Azar
5,662,720 A 9/1997 O'Tigheamaigh
5,678,644 A 10/1997 Fielder
5,709,279 A 1/1998 Dennis
5,720,528 A 2/1998 Ritchey
5,732,784 A 3/1998 Nelson
5,738,698 A 4/1998 Kapoor
5,794,728 A 8/1998 Palmberg
5,811,944 A 9/1998 Sampayan et al.
5,823,632 A 10/1998 Burkett
5,837,071 A 11/1998 Anderson
5,845,547 A 12/1998 Sollami
5,848,657 A 12/1998 Flood et al.
5,871,060 A 2/1999 Jensen et al.
5,875,862 A 3/1999 Jurewicz
5,884,979 A 3/1999 Latham
5,890,552 A 4/1999 Scott et al.
5,896,938 A 4/1999 Moeny
5,914,055 A 6/1999 Roberts et al.
5,934,542 A 8/1999 Nakamura
5,935,718 A 8/1999 Demo
5,944,129 A 8/1999 Jensen
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,967,250 A 10/1999 Lund
5,979,571 A 11/1999 Scott
5,992,405 A 11/1999 Sollami
5,992,547 A 11/1999 Caraway
5,992,548 A 11/1999 Silva
6,000,483 A 12/1999 Jurewicz et al.
6,003,623 A 12/1999 Miess
6,006,846 A 12/1999 Tibbitts et al.
6,018,729 A 1/2000 Zacharia et al.
6,019,434 A 2/2000 Emmerich
6,021,859 A 2/2000 Tibbitts
6,039,131 A 3/2000 Beaton
6,041,875 A 3/2000 Rai et al.
6,044,920 A 4/2000 Massa
6,051,079 A 4/2000 Andersson
6,056,911 A 5/2000 Griffin
6,065,552 A 5/2000 Scott
6,068,913 A 5/2000 Cho et al.
6,095,262 A 8/2000 Chen
6,098,730 A 8/2000 Scott et al.
6,113,195 A 9/2000 Mercier
6,131,675 A 10/2000 Anderson
6,150,822 A 11/2000 Hong
6,170,917 B1 1/2001 Heinrich et al.
6,186,251 B1 2/2001 Butcher
6,193,770 B1 2/2001 Sung
6,196,340 B1 3/2001 Jensen et al.
6,196,636 B1 3/2001 Mills
6,196,910 B1 3/2001 Johnson
6,199,645 B1 * 3/2001 Anderson et al. ..... 175/426
6,199,956 B1 3/2001 Kammerer
6,202,761 B1 3/2001 Forney
6,213,226 B1 4/2001 Eppink
6,216,805 B1 4/2001 Lays
6,220,375 B1 4/2001 Butcher et al.
6,220,376 B1 4/2001 Lundell
6,223,824 B1 5/2001 Moyes
6,223,974 B1 5/2001 Unde
6,257,673 B1 7/2001 Markham et al.
6,258,139 B1 7/2001 Jensen
6,260,639 B1 7/2001 Yong
6,269,893 B1 8/2001 Beaton
6,270,165 B1 8/2001 Peay
6,272,748 B1 8/2001 Smyth
6,290,007 B2 9/2001 Beuershausen
6,290,008 B1 9/2001 Portwood et al.
6,296,069 B1 10/2001 Lamine
6,302,224 B1 10/2001 Sherwood
6,302,225 B1 10/2001 Yoshida et al.
6,315,065 B1 11/2001 Yong et al.
6,332,503 B1 12/2001 Pessier et al.
6,340,064 B2 1/2002 Fielder
6,341,823 B1 1/2002 Sollami
6,354,771 B1 3/2002 Bauschulte
6,364,034 B1 4/2002 Schoeffler
6,364,420 B1 4/2002 Sollami
6,371,567 B1 4/2002 Sollami
6,375,272 B1 4/2002 Ojanen
6,375,706 B2 4/2002 Kembaiyan et al.
6,394,200 B1 5/2002 Watson
6,408,052 B1 6/2002 McGeoch
6,408,959 B2 6/2002 Bertagnolli et al.
6,412,560 B1 7/2002 Bernat
6,419,278 B1 7/2002 Cunningham
6,424,919 B1 7/2002 Moran

(56) References Cited

U.S. PATENT DOCUMENTS

| | | | |
|---|---|---|---|
| 6,429,398 | B1 | 8/2002 | Legoupil et al. |
| 6,435,287 | B2 | 8/2002 | Estes |
| 6,439,326 | B1 | 8/2002 | Huang |
| 6,460,637 | B1 | 10/2002 | Siracki et al. |
| 6,468,368 | B1 | 10/2002 | Merrick et al. |
| 6,474,425 | B1 | 11/2002 | Truax |
| 6,478,383 | B1 | 11/2002 | Ojanen |
| 6,481,803 | B2 | 11/2002 | Ritchey |
| 6,484,825 | B2 | 11/2002 | Watson |
| 6,484,826 | B1 | 11/2002 | Anderson et al. |
| 6,499,547 | B2 | 12/2002 | Scott |
| 6,508,318 | B1 | 1/2003 | Linden et al. |
| 6,510,906 | B1 | 1/2003 | Richert |
| 6,513,606 | B1 | 2/2003 | Krueger |
| 6,516,293 | B1 | 2/2003 | Huang |
| 6,517,902 | B2 | 2/2003 | Drake |
| 6,533,050 | B2 | 3/2003 | Molloy |
| 6,561,293 | B2 | 5/2003 | Minikus et al. |
| 6,562,462 | B2 | 5/2003 | Griffin et al. |
| D477,225 | S | 7/2003 | Pinnavaia |
| 6,585,326 | B2 | 7/2003 | Sollami |
| 6,592,985 | B2 | 7/2003 | Griffin et al. |
| 6,594,881 | B2 | 7/2003 | Tibbitts |
| 6,596,225 | B1 | 7/2003 | Pope |
| 6,601,454 | B1 | 8/2003 | Botnan |
| 6,601,662 | B2 * | 8/2003 | Matthias et al. ..... 175/374 |
| 6,622,803 | B2 | 9/2003 | Harvey |
| 6,668,949 | B1 | 12/2003 | Rives |
| 6,672,406 | B2 | 1/2004 | Beuershausen |
| 6,685,273 | B1 | 2/2004 | Sollami |
| 6,692,083 | B2 | 2/2004 | Latham |
| 6,702,393 | B2 | 3/2004 | Mercier |
| 6,709,065 | B2 | 3/2004 | Peay |
| 6,711,060 | B2 | 3/2004 | Sakakibara |
| 6,719,074 | B2 | 4/2004 | Tsuda et al. |
| 6,729,420 | B2 | 5/2004 | Mensa-Wilmot |
| 6,732,817 | B2 | 5/2004 | Dewey |
| 6,732,914 | B2 | 5/2004 | Cadden et al. |
| 6,733,087 | B2 | 5/2004 | Hall |
| 6,739,327 | B2 | 5/2004 | Sollami |
| 6,749,033 | B2 | 6/2004 | Griffin et al. |
| 6,758,530 | B2 | 7/2004 | Sollami |
| D494,031 | S | 8/2004 | Moore, Jr. |
| D494,064 | S | 8/2004 | Hook |
| 6,786,557 | B2 | 9/2004 | Montgomery, Jr. |
| 6,802,676 | B2 | 10/2004 | Noggle |
| 6,822,579 | B2 | 11/2004 | Goswani |
| 6,824,225 | B2 | 11/2004 | Stiffler |
| 6,846,045 | B2 | 1/2005 | Sollami |
| 6,851,758 | B2 | 2/2005 | Beach |
| 6,854,810 | B2 | 2/2005 | Montgomery, Jr. |
| 6,861,137 | B2 | 3/2005 | Griffin et al. |
| 6,878,447 | B2 | 4/2005 | Griffin |
| 6,879,947 | B1 | 4/2005 | Glass |
| 6,880,744 | B2 | 4/2005 | Noro et al. |
| 6,889,890 | B2 | 5/2005 | Yamazaki et al. |
| 6,929,076 | B2 | 8/2005 | Fanuel et al. |
| 6,933,049 | B2 | 8/2005 | Wan et al. |
| 6,953,096 | B2 | 10/2005 | Gledhill |
| 6,959,765 | B2 | 11/2005 | Bell |
| 6,962,395 | B2 | 11/2005 | Mouthaan |
| 6,966,611 | B1 | 11/2005 | Sollami |
| 6,994,404 | B1 | 2/2006 | Sollami |
| 7,048,081 | B2 | 5/2006 | Smith et al. |
| 7,104,344 | B2 | 9/2006 | Kriesels et al. |
| 7,152,703 | B2 | 12/2006 | Meiners et al. |
| 7,204,560 | B2 | 4/2007 | Mercier |
| 7,207,398 | B2 | 4/2007 | Runia et al. |
| D547,652 | S | 7/2007 | Kerman et al. |
| D560,699 | S | 1/2008 | Omi |
| 7,350,601 | B2 | 4/2008 | Belnap |
| 7,377,341 | B2 | 5/2008 | Middlemiss et al. |
| 7,380,888 | B2 | 6/2008 | Ojanen |
| 7,396,086 | B1 | 7/2008 | Hall et al. |
| 7,543,662 | B2 | 6/2009 | Belnap et al. |
| 7,575,425 | B2 | 8/2009 | Hall et al. |
| 7,592,077 | B2 | 9/2009 | Gates, Jr. et al. |
| 7,647,992 | B2 | 1/2010 | Fang et al. |
| 7,665,552 | B2 | 2/2010 | Hall et al. |
| 7,693,695 | B2 | 4/2010 | Huang et al. |
| 7,703,559 | B2 | 4/2010 | Shen et al. |
| 7,730,977 | B2 | 6/2010 | Achilles |
| 7,757,785 | B2 | 7/2010 | Zhang et al. |
| 7,798,258 | B2 | 9/2010 | Singh et al. |
| 2001/0004946 | A1 | 6/2001 | Jensen |
| 2001/0040053 | A1 | 11/2001 | Beuershausen |
| 2002/0074851 | A1 | 6/2002 | Montgomery et al. |
| 2002/0153175 | A1 | 10/2002 | Ojanen |
| 2002/0175555 | A1 | 11/2002 | Mercier |
| 2003/0044800 | A1 | 3/2003 | Connelly |
| 2003/0140350 | A1 | 7/2003 | Watkins et al. |
| 2003/0141350 | A1 | 7/2003 | Noro |
| 2003/0209366 | A1 | 11/2003 | McAlvain |
| 2003/0213621 | A1 | 11/2003 | Britten |
| 2003/0217869 | A1 | 11/2003 | Snyder et al. |
| 2003/0234280 | A1 | 12/2003 | Cadden |
| 2004/0026132 | A1 | 2/2004 | Hall |
| 2004/0026983 | A1 | 2/2004 | McAlvain |
| 2004/0065484 | A1 | 4/2004 | McAlvain |
| 2004/0155096 | A1 | 8/2004 | Zimmerman et al. |
| 2004/0238221 | A1 | 12/2004 | Runia |
| 2004/0256155 | A1 | 12/2004 | Kriesels |
| 2004/0256442 | A1 | 12/2004 | Gates, Jr. |
| 2005/0044800 | A1 | 3/2005 | Hall |
| 2005/0080595 | A1 | 4/2005 | Huang |
| 2005/0103530 | A1 | 5/2005 | Wheeler et al. |
| 2005/0159840 | A1 | 7/2005 | Lin |
| 2005/0173966 | A1 | 8/2005 | Mouthaan |
| 2005/0263327 | A1 | 12/2005 | Meiners et al. |
| 2006/0032677 | A1 | 2/2006 | Azar et al. |
| 2006/0060391 | A1 | 3/2006 | Eyre et al. |
| 2006/0086537 | A1 | 4/2006 | Dennis |
| 2006/0086540 | A1 | 4/2006 | Griffin |
| 2006/0162969 | A1 | 7/2006 | Belnap et al. |
| 2006/0180354 | A1 | 8/2006 | Belnap et al. |
| 2006/0180356 | A1 | 8/2006 | Durairajan |
| 2006/0186724 | A1 | 8/2006 | Stehney |
| 2006/0237236 | A1 | 10/2006 | Sreshta |
| 2007/0106487 | A1 | 5/2007 | Gavia |
| 2007/0193782 | A1 | 8/2007 | Fang |
| 2007/0221408 | A1 | 9/2007 | Hall et al. |
| 2007/0278017 | A1 | 12/2007 | Shen et al. |
| 2008/0006448 | A1 | 1/2008 | Zhang et al. |
| 2008/0011522 | A1 | 1/2008 | Hall et al. |
| 2008/0053710 | A1 | 3/2008 | Moss |
| 2008/0073126 | A1 | 3/2008 | Shen et al. |
| 2008/0073127 | A1 | 3/2008 | Zhan et al. |
| 2008/0142276 | A1 | 6/2008 | Griffo et al. |
| 2008/0156544 | A1 | 7/2008 | Singh et al. |
| 2008/0206576 | A1 | 8/2008 | Qian et al. |
| 2009/0166091 | A1 | 7/2009 | Matthews et al. |
| 2009/0223721 | A1 | 9/2009 | Dourfaye |

FOREIGN PATENT DOCUMENTS

| | | |
|---|---|---|
| DE | 3818213 | 11/1989 |
| DE | 4039217 | 6/1992 |
| DE | 19821147 | 11/1999 |
| DE | 10163717 | 5/2003 |
| EP | 0295151 | 6/1988 |
| EP | 0412287 | 7/1990 |
| GB | 2004315 | 3/1979 |
| GB | 2037223 | 11/1979 |
| JP | 5280273 | 10/1993 |

OTHER PUBLICATIONS

International search report for PCT/US2007/075670 dated Nov. 17, 2008.

G. Jeffery Hoch, Is There Room for Geothermal Energy, Innovation: America's Journal of Technology Communication, Dec. 2006/Jan. 2007, http://www.innovation-america.org/.

(56) References Cited

OTHER PUBLICATIONS

David A. Glowka, et al., Progress in the Advanced Synthetic-Diamond Drill Bit Program, 1995.
Mark A. Taylor, The State of Geothermal Technology Part 1: Subsurface Technology, pp. 29-30, Geothermal Energy Association, Nov. 2007, Washington, D.C.
Christopher J. Durrand, Super-hard, Thick Shaped PDC Cutters for Hard Rock Drilling: Development and Test Results, Feb. 3, 2010, Geothermal Reservoir Engineering, Stanford, California.
Dan Jennejohn, Research and Development in Geothermal Exploration and Drilling, pp. 5, Dec. 18-19, 2009, Geothermal Energy Association, Washington, D.C.
Chaturvedi et al., Diffusion Brazing of Cast Inconel 738 Superalloy, Sep. 2005, Journal of Materials Online (http://www.azom.com/details.asp?ArticleID=2995).
International Preliminary Report on Patentability Chapter I for PCT/US07/75670, completed Feb. 17, 2009, 6 pages.
International Preliminary Report on Patentability Chapter II for PCT/US07/75670, completed Aug. 24, 2009, 4 pages.

* cited by examiner

CUTTING ELEMENT ATTACHED TO DOWNHOLE FIXED BLADED BIT AT A POSITIVE RAKE ANGLE

CROSS REFERENCE TO RELATED APPLICATIONS

This application is a continuation-in-part of U.S. patent application Ser. No. 11/766,975 filed on Jun. 22, 2007 and that issued as U.S. Pat. No. 8,122,980 on Feb. 28, 2012. This application is also a continuation-in-part of U.S. patent application Ser. No. 11/774,227 filed on Jul. 6, 2007 and that issued as U.S. Pat. No. 7,669,938 on Mar. 2, 2010. U.S. patent application Ser. No. 11/774,227 is a continuation-in-part of U.S. patent application Ser. No. 11/773,271 filed on Jul. 3, 2007 and that issued as U.S. Pat. No. 7,997,661 on Aug. 16, 2011. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007 now abandoned. U.S. patent application Ser. No. 11/766,865 is a continuation-in-part of U.S. patent application Ser. No. 11/742,304 filed on Apr. 30, 2007 and that issued as U.S. Pat. No. 7,475,948 on Jan. 13, 2009. U.S. patent application Ser. No. 11/742,304 is a continuation of U.S. patent application Ser. No. 11/742,261 filed on Apr. 30, 2007 and that issued as U.S. Pat. No. 7,469,971 on Dec. 30, 2008. U.S. patent application Ser. No. 11/742,261 is a continuation-in-part of U.S. patent application Ser. No. 11/464,008 filed on Aug. 11, 2006 and that issued as U.S. Pat. No. 7,338,135 on Mar. 4, 2008. U.S. patent application Ser. No. 11/464,008 is a continuation-in-part of U.S. patent application Ser. No. 11/463,998 filed on Aug. 11, 2006 and that issued as U.S. Pat. No. 7,384,105 on Jun. 10, 2008. U.S. patent application Ser. No. 11/463,998 is a continuation-in-part of U.S. patent application Ser. No. 11/463,990 filed on Aug. 11, 2006 and that issued as U.S. Pat. No. 7,320,505 on Jan. 22, 2008. U.S. patent application Ser. No. 11/463,990 is a continuation-in-part of U.S. patent application Ser. No. 11/463,975 filed on Aug. 11, 2006 and that issued as U.S. Pat. No. 7,445,294 on Nov. 4, 2008. U.S. patent application Ser. No. 11/463,975 is a continuation-in-part of U.S. patent application Ser. No. 11/463,962 filed on Aug. 11, 2006 and that issued as U.S. Pat. No. 7,413,256 on Aug. 19, 2008. The present application is also a continuation-in-part of U.S. patent application Ser. No. 11/695,672 filed on Apr. 3, 2007 and that issued as U.S. Pat. No. 7,396,086 on Jul. 8, 2008. U.S. patent application Ser. No. 11/695,672 is a continuation-in-part of U.S. patent application Ser. No. 11/686,831 filed on Mar. 15, 2007 and that issued as U.S. Pat. No. 7,568,770 on Aug. 4, 2009. This application is also a continuation-in-part of U.S. patent application Ser. No. 11/673,634 filed Feb. 12, 2007 and that issued as U.S. Pat. No. 8,109,349 on Feb. 7, 2012. All of these applications are herein incorporated by reference for all that they contain.

BACKGROUND OF THE INVENTION

This invention relates to drill bits, specifically drill bit assemblies for use in oil, gas and geothermal drilling. More particularly, the invention relates to cutting elements in fix bladed bits comprised of a carbide substrate with a non-planar interface and an abrasion resistant layer of super hard material affixed thereto using a high-pressure/high-temperature press apparatus.

Cutting elements typically comprise a cylindrical super hard material layer or layers formed under high temperature and pressure conditions, usually in a press apparatus designed to create such conditions, cemented to a carbide substrate containing a metal binder or catalyst, such as cobalt. A cutting element or insert is normally fabricated by placing a cemented carbide substrate into a container or cartridge with a layer of diamond crystals or grains loaded into the cartridge adjacent one face of the substrate. A number of such cartridges are typically loaded into a reaction cell and placed in the high-pressure/high-temperature (HPHT) press apparatus. The substrates and adjacent diamond crystal layers are then compressed under HPHT conditions which promotes a sintering of the diamond grains to form the polycrystalline diamond structure. As a result, the diamond grains become mutually bonded to form a diamond layer over the substrate interface. The diamond layer is also bonded to the substrate interface.

Such cutting elements are often subjected to intense forces, torques, vibration, high temperatures and temperature differentials during operation. As a result, stresses within the structure may begin to form. Drag bits for example may exhibit stresses aggravated by drilling anomalies, such as bit whirl or bounce, during well boring operations, often resulting in spalling, delamination or fracture of the super hard abrasive layer or the substrate, thereby reducing or eliminating the cutting elements' efficacy and decreasing overall drill bit wear-life. The super hard material layer of a cutting element sometimes delaminates from the carbide substrate after the sintering process as well as during percussive and abrasive use. Damage typically found in drag bits may be a result of shear failures, although non-shear modes of failure are not uncommon. The interface between the super hard material layer and substrate is particularly susceptible to non-shear failure modes due to inherent residual stresses.

U.S. Pat. No. 6,332,503 by Pessier et al., which is herein incorporated by reference for all that it contains, discloses an array of chisel-shaped cutting elements mounted to the face of a fixed cutter bit. Each cutting element has a crest and an axis which is inclined relative to the borehole bottom. The chisel-shaped cutting elements may be arranged on a selected portion of the bit, such as the center of the bit, or across the entire cutting surface. In addition, the crest on the cutting elements may be oriented generally parallel or perpendicular to the borehole bottom.

U.S. Pat. No. 6,408,959 by Bertagnolli et al., which is herein incorporated by reference for all that it contains, discloses a cutting element, insert or compact that is provided for use with drills used in the drilling and boring of subterranean formations.

U.S. Pat. No. 6,484,826 by Anderson et al., which is herein incorporated by reference for all that it contains, discloses enhanced inserts formed having a cylindrical grip and a protrusion extending from the grip.

U.S. Pat. No. 5,848,657 by Flood et al., which is herein incorporated by reference for all that it contains, discloses a domed polycrystalline diamond cutting element, wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material is disposed over said distal end portion such that an annulus of metal carbide adjacent and above said drill bit is not covered by said abrasive material layer.

U.S. Pat. No. 4,109,737 by Bovenkerk which is herein incorporated by reference for all that it contains, discloses a rotary bit for rock drilling comprising a plurality of cutting elements mounted by interference—fit in recesses in the crown of the drill bit. Each cutting element comprises an elongated pin with a thin layer of polycrystalline diamond bonded to the free end of the pin.

US Patent Application Publication No. 2001/0004946 by Jensen, now abandoned, is herein incorporated by reference for all that it discloses. Jensen teaches that a cutting element or insert has improved wear characteristics while maximizing the manufacturability and cost effectiveness of the insert. This insert employs a superabrasive diamond layer of increased depth and makes use of a diamond layer surface that is generally convex.

BRIEF SUMMARY OF THE INVENTION

In one aspect of the present invention, a downhole fixed bladed bit comprises a working surface comprising a plurality of blades converging at a center of the working surface and diverging towards a gauge of the bit, at least one blade comprising a cutting element comprising a superhard material bonded to a cemented metal carbide substrate at a non-planer interface, the cutting element being positioned at a positive rake angle, and the superhard material comprising a substantially conical geometry with an apex comprising a curvature.

In some embodiments, the positive rake angle may be between 15 and 20 degrees, and may be substantially 17 degrees. The cutting element may comprise the characteristic of inducing fractures ahead of itself in a formation when the drill bit is drilling through the formation. The cutting element may comprise the characteristic of inducing fractures peripherally ahead of itself in a formation when the drill bit is drilling through the formation.

The substantially conical geometry may comprise a side wall that tangentially joins the curvature, wherein the cutting element is positioned to indent at a positive rake angle, while a leading portion of the side wall is positioned at a negative rake angle.

The cutting element may be positioned on a flank of the at least one blade, and may be positioned on a gauge of the at least one blade. The included angle of the substantially conical geometry may be 75 to 90 degrees. The superhard material may comprise sintered polycrystalline diamond. The sintered polycrystalline diamond may comprise a volume with less than 5 percent catalyst metal concentration, while 95 percent of the interstices in the sintered polycrystalline diamond comprise a catalyst.

The non-planar interface may comprise an elevated flatted region that connects to a cylindrical portion of the substrate by a tapered section. The apex may join the substantially conical geometry at a transition that comprises a diameter less than one-third of a diameter of the carbide substrate. In some embodiments, the diameter of the transition may be less than one-quarter of the diameter of the substrate.

The curvature may be comprise a constant radius, and may be less than 0.120 inches. The curvature may be defined by a portion of an ellipse or by a portion of a parabola. The curvature may be defined by a portion of a hyperbola or a catenary, or by combinations of any conic section.

DETAILED DESCRIPTION OF THE INVENTION AND THE PREFERRED EMBODIMENT

Figure 1:
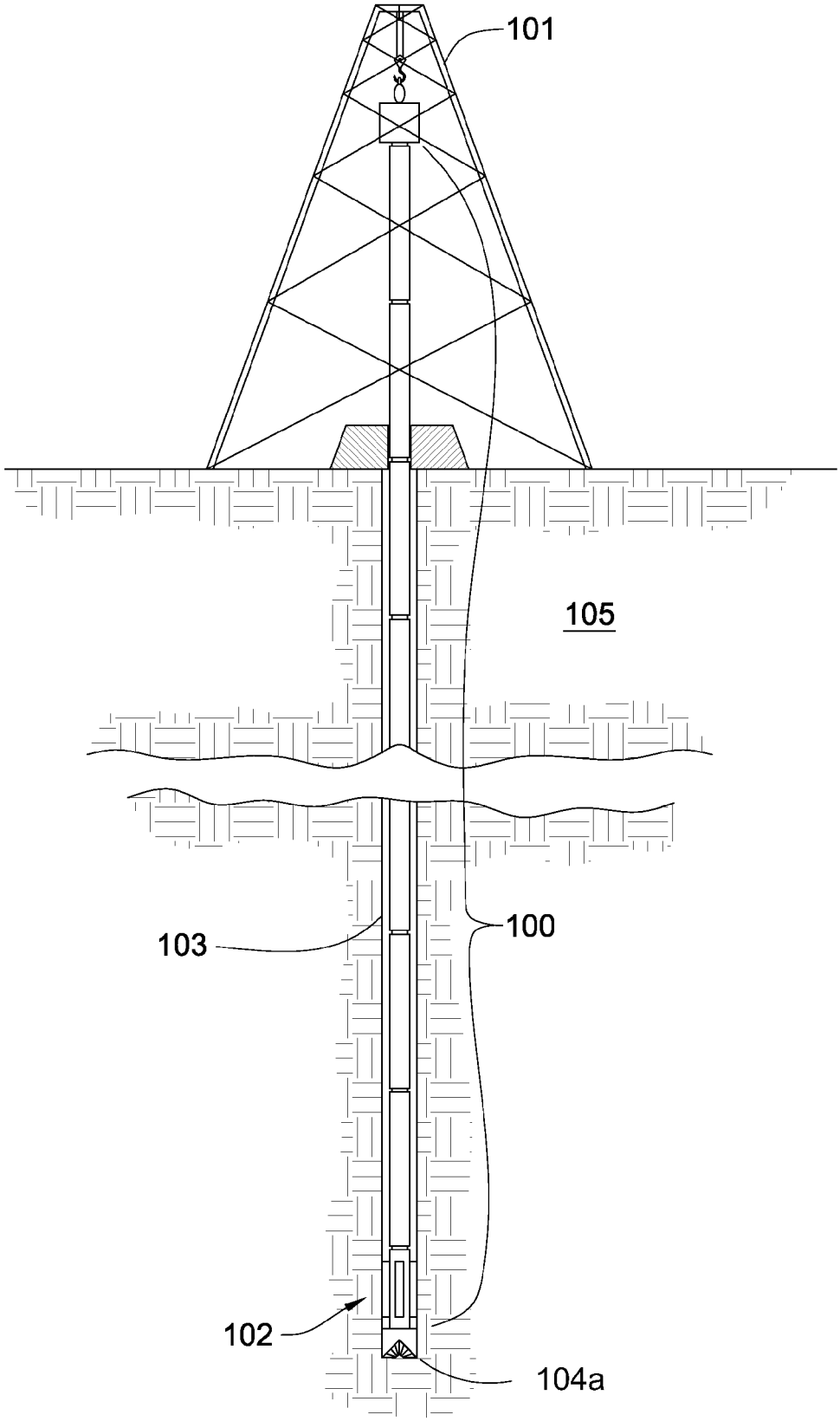
FIG. 1 is a cross-sectional view of an embodiment of a drilling operation.

Referring now to the figures, FIG. 1 is a cross-sectional diagram of an embodiment of a drill string 100 suspended by a derrick 101. A bottom-hole assembly 102 is located at the bottom of a bore hole 103 and comprises a fixed bladed drill bit 104*a*. As the drill bit 104*a* rotates down hole the drill string 100 advances farther into the earth. The drill string 100 may penetrate soft or hard subterranean formations 105.

Figure 2A:
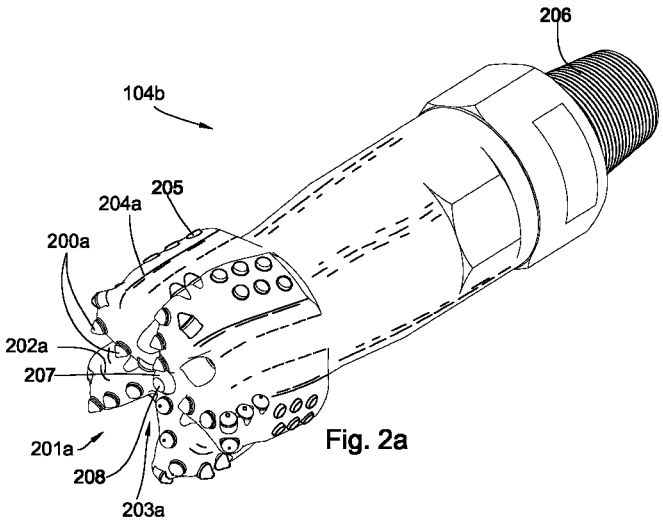
FIG. 2*a* is a perspective view of an embodiment of a drill bit.

FIG. 2*a* discloses an embodiment of a drill bit 104*b*. Drill bit 104*b* comprises a working surface 201*a* comprising a plurality of radial blades 202*a*. Blades 202*a* converge towards a center 203*a* of the working surface 201*a* and diverge towards a gauge portion 204*a*. Blades 202*a* may comprise one or more cutting elements 200*a* that comprise a superhard material bonded to a cemented metal carbide substrate at a non-planer interface. Cutting elements 200*a* may comprise substantially pointed geometry, and may comprise a superhard material such as polycrystalline diamond processed in a high-temperature/high-pressure press. The gauge portion 204*a* may comprise wear-resistant inserts 205 that may comprise a superhard material. Drill Bit 104*b* may comprise a shank portion 206 that may be attached to a portion of a drill string or a bottom-hole assembly (BHA). In some embodiments, one or more cutting elements 200*a* may be positioned on a flank portion or a gauge portion 204*a* of the drill bit 104*b*.

In some embodiments, the drill bit 104*b* may comprise an indenting member 207 comprising a cutting element 208. Cutting element 208 may comprise the same geometry and material as cutting elements 200*a*, or may comprise a different geometry, dimensions, materials, or combinations thereof. The indenting member 207 may be rigidly fixed to the drill bit 104 through a press fit, braze, threaded connection, or other method. The indenting member 207 may comprise an asymmetrical geometry. In some embodiments, the indenting member 207 is substantially coaxial with an axis of rotation of the drill bit 104*b*. In other embodiments, the indenting member 207 may be off-center.

Figure 2B:
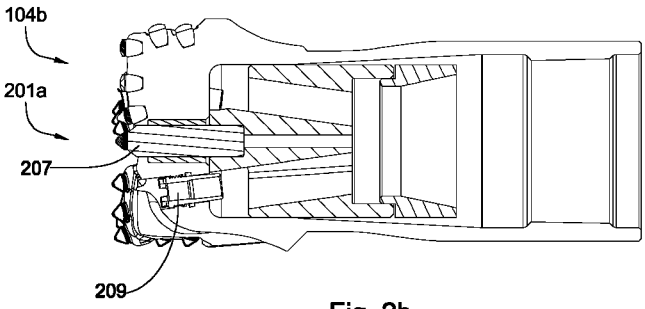
FIG. 2*b* is a cross-sectional view of the drill bit in FIG. 2*a*.

FIG. 2*b* discloses a cross section of the embodiment of the drill bit 104*b*. The indenting member 207 is retained in the body of the drill bit 104*b*. A nozzle 209 carries drilling fluid to the working surface 201*a* to cool and lubricate the working surface 201*a* and carry the drilling chips and debris to the surface.

Figure 2C:
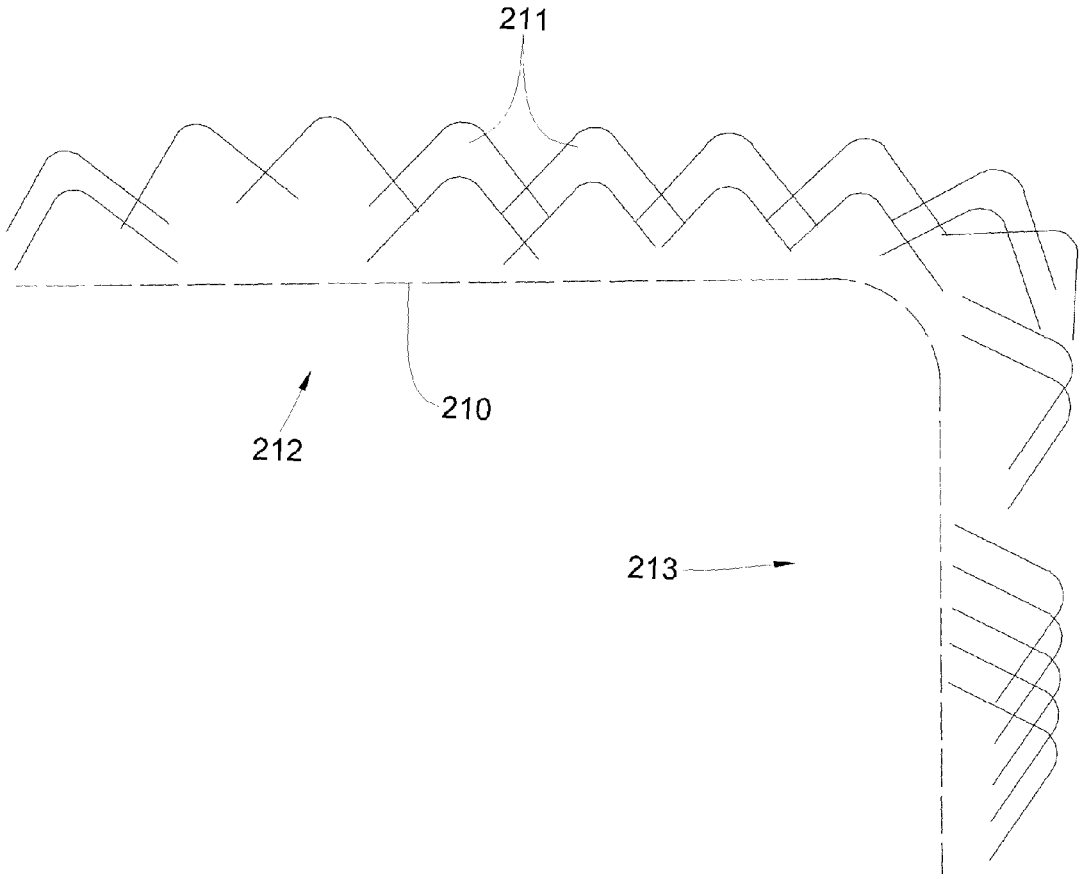
FIG. 2*c* is an orthogonal view a cutting element profile of the drill bit in FIG. 2*a*.

FIG. 2*c* shows a blade profile 210 with cutter profiles 211 from a plurality of blades 202*a* superimposed on the blade profile 210. Cutter profiles 211 substantially define a cutting path when the drill bit 104*b* is in use. Cutter profiles 211 substantially cover the blade profile 210 between a central portion 212 of the blade profile 210 and a gauge portion 213 of the blade profile 210.

Figure 3:
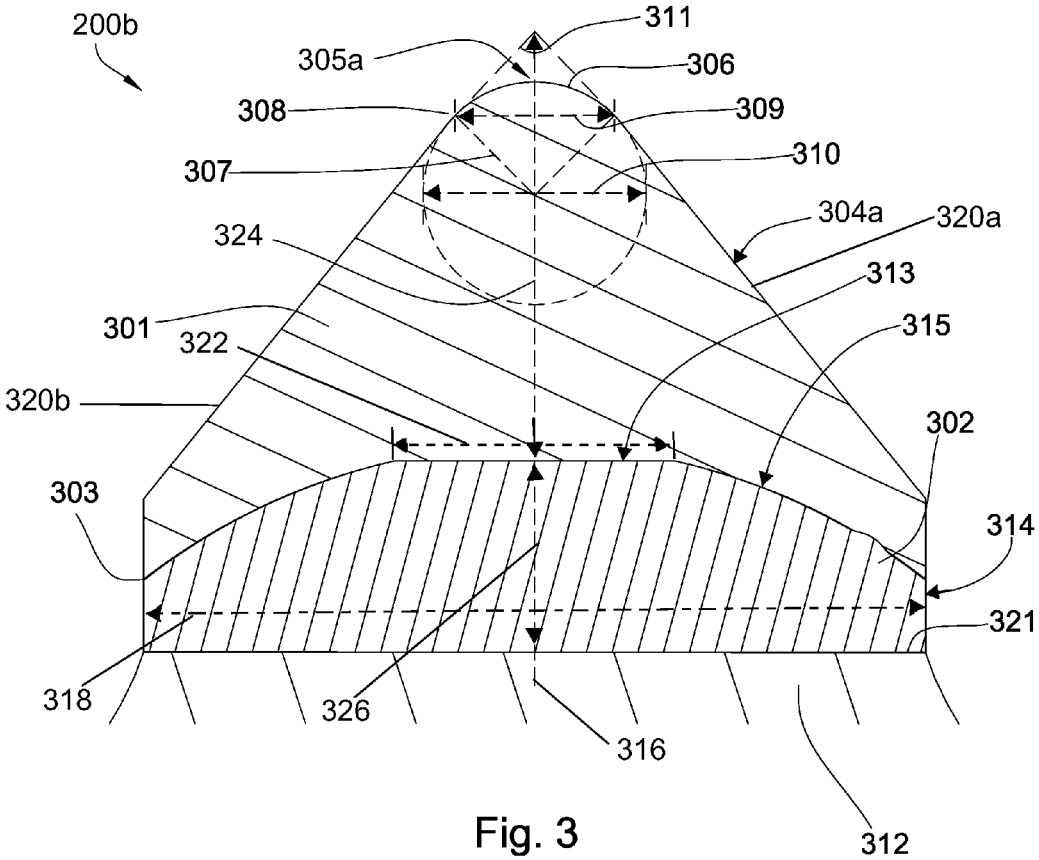
FIG. 3 is a cross-sectional view of an embodiment of a cutting element.

FIG. 3 discloses an embodiment of a cutting element 200*b*. In this embodiment, the cutting element 200*b* comprises a superhard material portion 301 comprising sintered polycrystalline diamond bonded to a cemented metal carbide substrate 302 at a non-planar interface 303. The cutting element 200*b* comprises substantially pointed geometry 304*a* and an apex 305*a*.

The apex 305*a* may comprise a curvature 306. In this embodiment, curvature 306 comprises a radius of curvature 307. In this embodiment, the radius of curvature 307 may be less than 0.120 inches.

In some embodiments, the curvature may comprise a variable radius of curvature, a portion of a parabola, a portion of a hyperbola, a portion of a catenary, or a parametric spline.

The curvature 306 of the apex 305*a* may join the pointed geometry 304*a* at a substantially tangential transition 308. The transition 308 forms a diameter 309 that may be substantially smaller than a diameter 310, or twice the radius of curvature 307. The diameter 309 may be less than one-third of a diameter 318 of the carbide substrate 302. In some embodiments, the diameter 309 may be less than one-fourth of the diameter 318 of the carbide substrate 302.

An included angle 311 is formed by walls 320*a* and 320*b* of the pointed geometry 304*a*. In some embodiments, the included angle 311 may be between 75 degrees and 90 degrees. Non-planar interface 303 comprises an elevated flatted region 313 that connects to a cylindrical portion 314 of the substrate 302 by a tapered section 315. The elevated flatted region 313 may comprise a diameter 322 larger than the diameter 309.

A volume of the superhard material portion 301 may be greater than a volume of the cemented metal carbide substrate 302.

A thickness 324 of the superhard material portion 301 along a central axis 316 may be greater than a thickness 326 of the cemented metal carbide substrate 302 along the central axis 316. The thickness 326 of the cemented metal carbide substrate 302 may be less than 10 mm along the central axis 316.

In some embodiments, the sintered polycrystalline diamond comprises a volume with less than 5 percent catalyst metal concentration, while 95 percent of the interstices in the sintered polycrystalline diamond comprise a catalyst.

The cemented metal carbide substrate 302 may be brazed to a support or bolster 312. The bolster 312 may comprise cemented metal carbide, a steel matrix material, or other material and may be press fit or brazed to a drill bit body.

Figure 4:
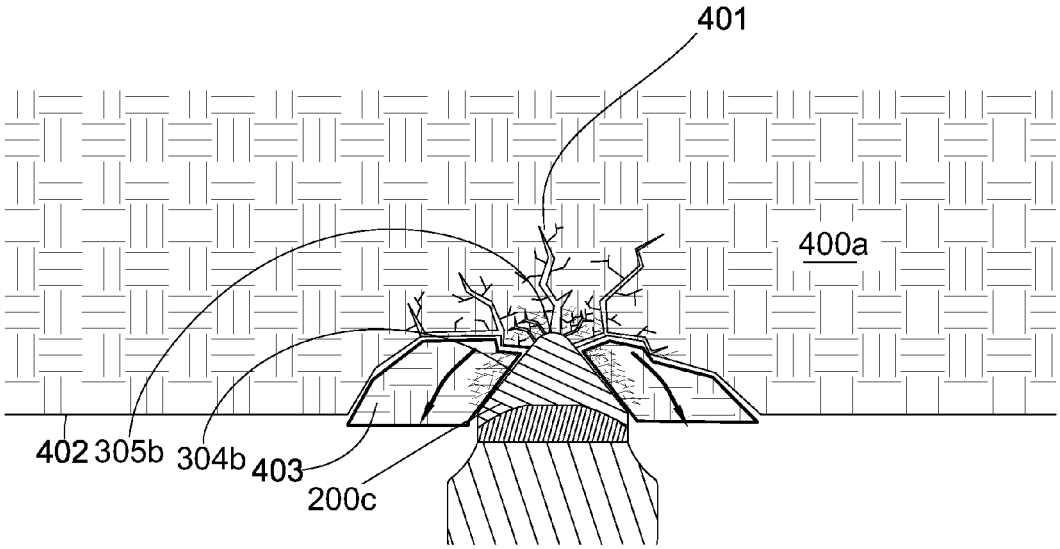
FIG. 4 is a cross-sectional view of an embodiment of a cutting element impinging a formation.

FIG. 4 discloses a cutting element 200*c* interacting with a formation 400*a*. Surprisingly, the pointed cutting element 200*c* has a different cutting mechanism than that of traditional shear cutters (generally cylindrical shaped cutting elements), resulting in the pointed cutting element 200*c* having a prolonged life. The short cutting life of the traditional shear cutter is a long-standing problem in the art, which the curvature of the present cutting element 200*c* overcomes.

Cutting element 200*c* comprises a pointed geometry 304*b* and an apex 305*b*. The apex 305*b* comprises a curvature that is sharp enough to easily penetrate the formation 400*a*, but is still blunt enough to fail the formation 400*a* in compression ahead of the cutting element 200*c*.

As the cutting element 200*c* advances in the formation 400*a*, apex 305*b* fails the formation 400*a* ahead of the cutting element 200*c* and peripherally to the sides of the cutting element 200*c*, creating fractures 401.

Fractures 401 may continue to propagate as the cutting element 200*c* advances into the formation 400*a*, eventually reaching the surface 402 of the formation 400*a* and allowing large chips 403 to break from the formation 400*a*.

Traditional shear cutters drag against the formation and shear off thin layers of formation. The large chips 403 comprise a greater volume size than the debris removed by the traditional shear cutters. Thus, the specific energy required to remove formation 400*a* with the pointed cutting element 200*c* is lower than that required with the traditional shear cutters. The cutting mechanism of the pointed cutting element 200*c* is more efficient since less energy is required to remove a given volume of rock.

In addition to the different cutting mechanism, the curvature of the apex 305*b* produces unexpected results. Applicants tested the abrasion of the pointed cutting element 200*c* against several commercially available shear cutters with diamond material of better predicted abrasion resistant qualities than the diamond material of the pointed cutting element 200*c*. Surprisingly, the pointed cutting element 200*c* outperformed the shear cutters. Applicant found that a radius of curvature between 0.050 to 0.120 inches produced the best wear results.

The majority of the time the cutting element 200*c* engages the formation 400*a*, the cutting element 200*c* is believed to be insulated, if not isolated, from virgin formation. Fractures 401 in the formation 400*a* weaken the formation 400*a* below the compressive strength of the virgin formation 400*a*. The fragments of the formation 400*a* are surprisingly pushed ahead by the curvature of the apex 305*b*, which induces fractures 401 further ahead of the cutting element 200*c*. In this repeated manner, the apex 305*b* may hardly, if at all, engage virgin formation 400*a* and thereby reduce the exposure of the apex 305*b* to the most abrasive portions of the formation 400*a*.

Figure 5:
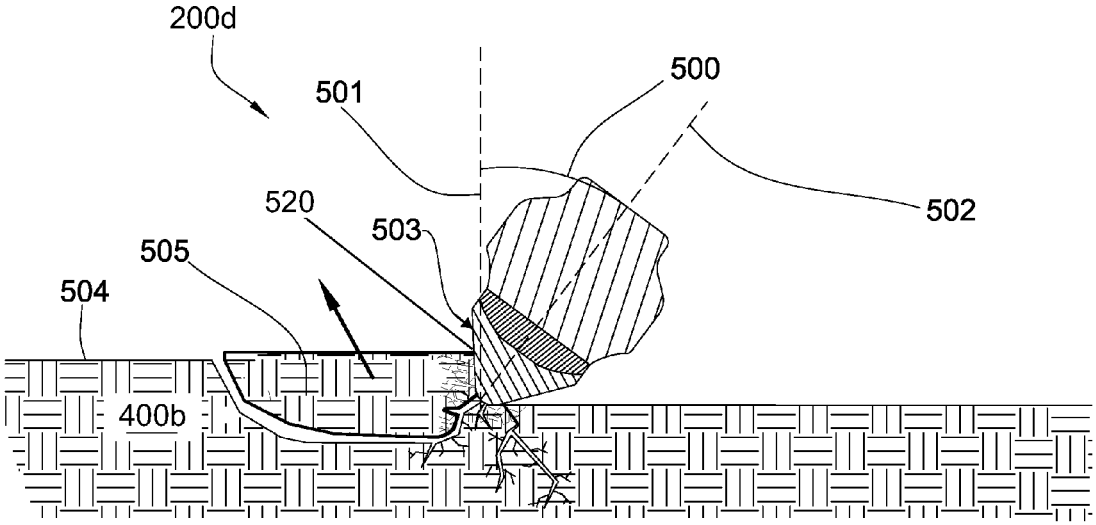
FIG. 5 is a cross-sectional view of another embodiment of a cutting element impinging a formation.

FIG. 5 discloses a cutting element 200*d* comprising a positive rake angle 500. Rake angle 500 is formed between an imaginary vertical line 501 and a central axis 502 of the cutting element 200*d*. In this embodiment, positive rake angle 500 is less than one-half of an included angle (e.g., included angle 311 in FIG. 3) formed between conical side walls (e.g., side walls 320*a* and 320*b* in FIG. 3) of the cutting element 200*d*, causing a leading portion 503 of a side wall 520 to form a negative rake angle with respect to the vertical line 501. The positive rake angle 500 may be 15-20 degrees, and in some embodiments may be substantially 17 degrees.

As the cutting element 200*d* advances in a formation 400*b*, it induces fractures ahead of the cutting element 200*d* and peripherally ahead of the cutting element 200*d*. Fractures may propagate to the surface 504 of the formation 400*b* allowing a chip 505 to break free.

Figure 6:
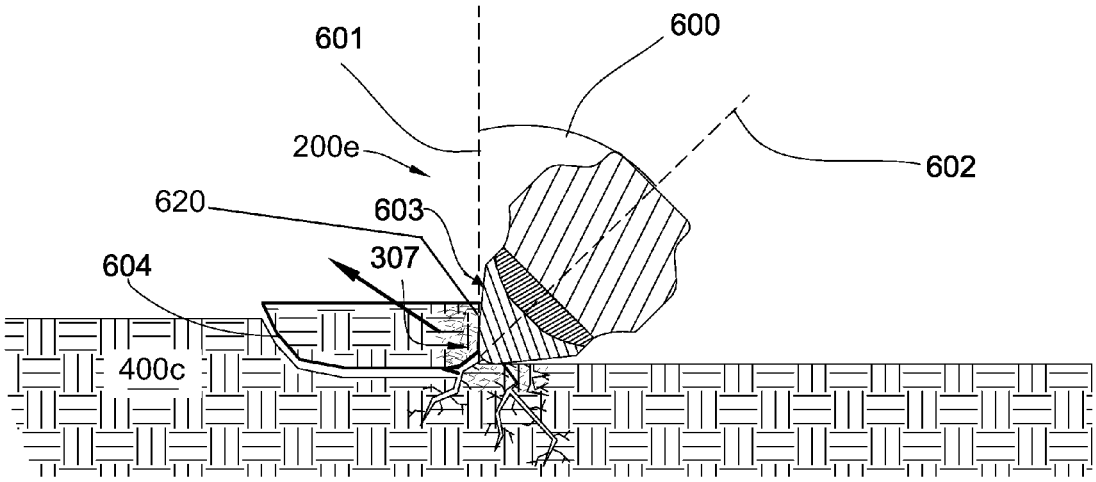
FIG. 6 is a cross-sectional view of another embodiment of a cutting element impinging a formation.

FIG. 6 discloses another embodiment of a cutting element 200*e* engaging a formation 400*c*. In this embodiment, a positive rake angle 600 between a vertical line 601 and a central axis 602 of the cutting element 200*e* is greater than one-half of the included angle (e.g., included angle 311 in FIG. 3) formed between conical side walls (e.g., side walls 320*a* and 320*b* in FIG. 3) of the cutting element 200*e*, causing a leading portion 603 of a side wall 620 to form a positive rake angle with the imaginary vertical line 601. This orientation of the cutting element 200*e* may encourage propagation of fractures 604, lessening the reaction forces and abrasive wear on the cutting element 200*e*.

Figure 7:
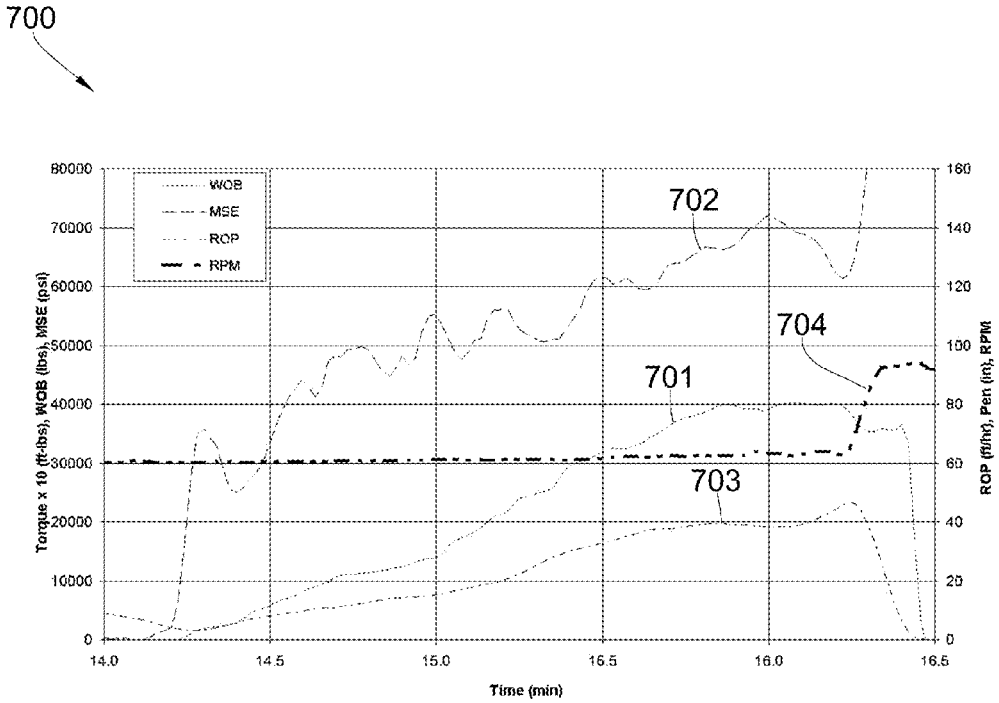
FIG. 7 is a time vs. parameter chart of an embodiment of a drill bit.

FIG. 7 is a chart 700 showing relationships between weight-on-bit (WOB) 701, mechanical specific energy (MSE) 702, rate of penetration (ROP) 703, and revolutions per minute (RPM) 704 of a drill bit from actual test data generated at TerraTek, located in Salt Lake City, Utah. As shown in the chart 700, ROP 703 increases with increasing WOB 701. MSE 702 represents the efficiency of the drilling operation in terms of an energy input to the operation and energy needed to degrade a formation. Increasing WOB 701 can increase MSE 702 to a point of diminishing returns shown at approximately 16 minutes on the abscissa. These results show that the specific mechanical energy for removing the formation is better than a traditional test.

Figure 8:
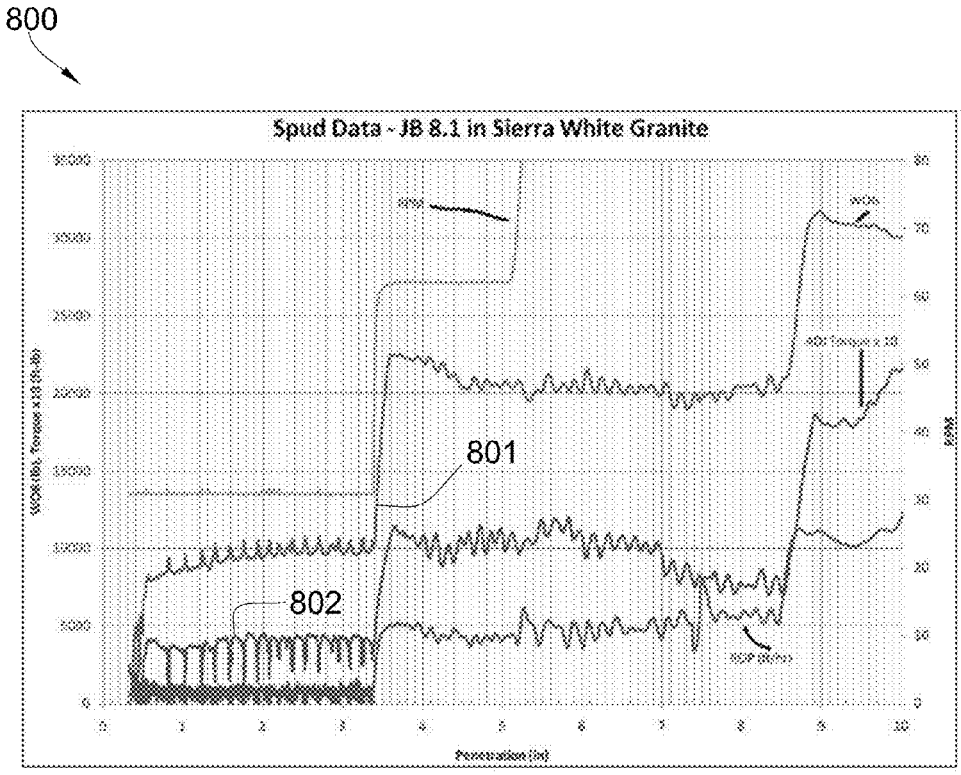
FIG. 8 is a penetration vs. parameter chart of an embodiment of a drill bit.

FIG. 8 is a chart 800 showing the drilling data of a drill bit with an indenting member also tested at TerraTek. As shown in the chart, WOB 801 and torque 802 oscillate. Torque 802 applied to the drill string undergoes corresponding oscillations opposite in phase to the WOB 801.

It is believed that these oscillations are a result of the WOB 801 reaction force at the drill bit working face alternating between the indenting member (e.g., indenting member 207 in FIG. 2*a*) and the blades (e.g., blades 202*s* in FIG. 2*a*). When the WOB 801 is substantially supported by the indenting member, the torque 802 required to tum the drill bit is lower. When the WOB 801 at the indenting member gets large enough, the indenting member fails the formation ahead of it, transferring the WOB 801 to the blades. When the drill bit blades come into greater engagement with the formation and support the WOB 801, the torque 802 increases. As the blades remove additional formation, the WOB 801 is loaded to the indenting member and the torque 802 decreases until the formation ahead of the indenting member again fails in compression. The compressive failure at the center of the working face by the indenting member shifts the WOB 801 so as to hammer the blades into the formation thereby reducing the work for the blades. The geometry of the indenting member and working face may be chosen advantageously to encourage such oscillations.

In some embodiments, such oscillations may be induced by moving the indenting member along an axis of rotation of the drill bit. Movements may be induced by a hydraulic, electrical, or mechanical actuator. In one embodiment, drilling fluid flow is used to actuate the indenting member.

Figure 9:
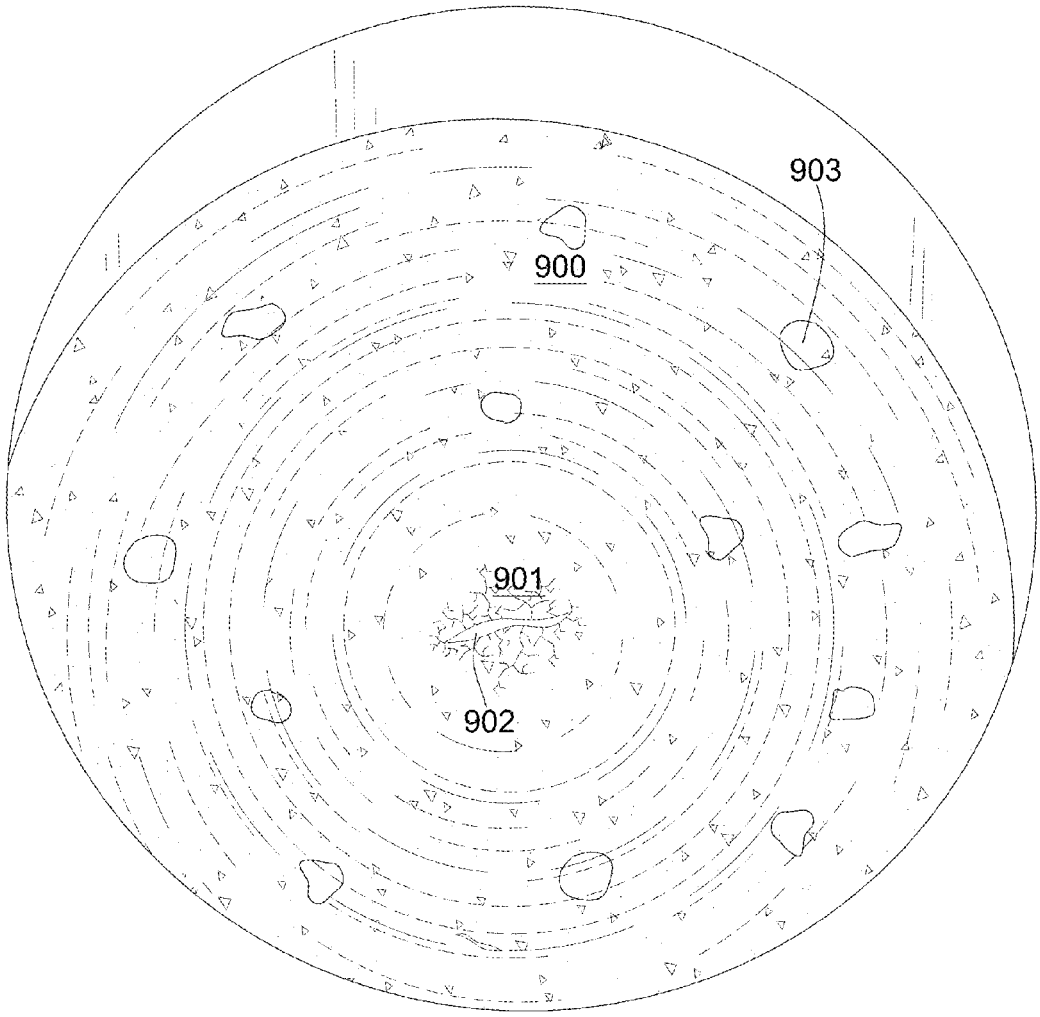
FIG. 9 is a perspective view of a bottom of a borehole drilled by an embodiment of a drill bit.

FIG. 9 shows a bottom of a borehole 900 of a sample formation drilled by a drill bit comprising an indenting member and radial blades comprising substantially pointed cutting elements. A central area 901 comprises fractures 902 created by the indenting member. Craters 903 form where blade elements on the blades strike the formation upon failure of the rock under the indenting member. The cracks ahead of the cutting elements propagate and create large chips that are removed by the pointed cutting elements and the flow of drilling fluid.

Figure 10:
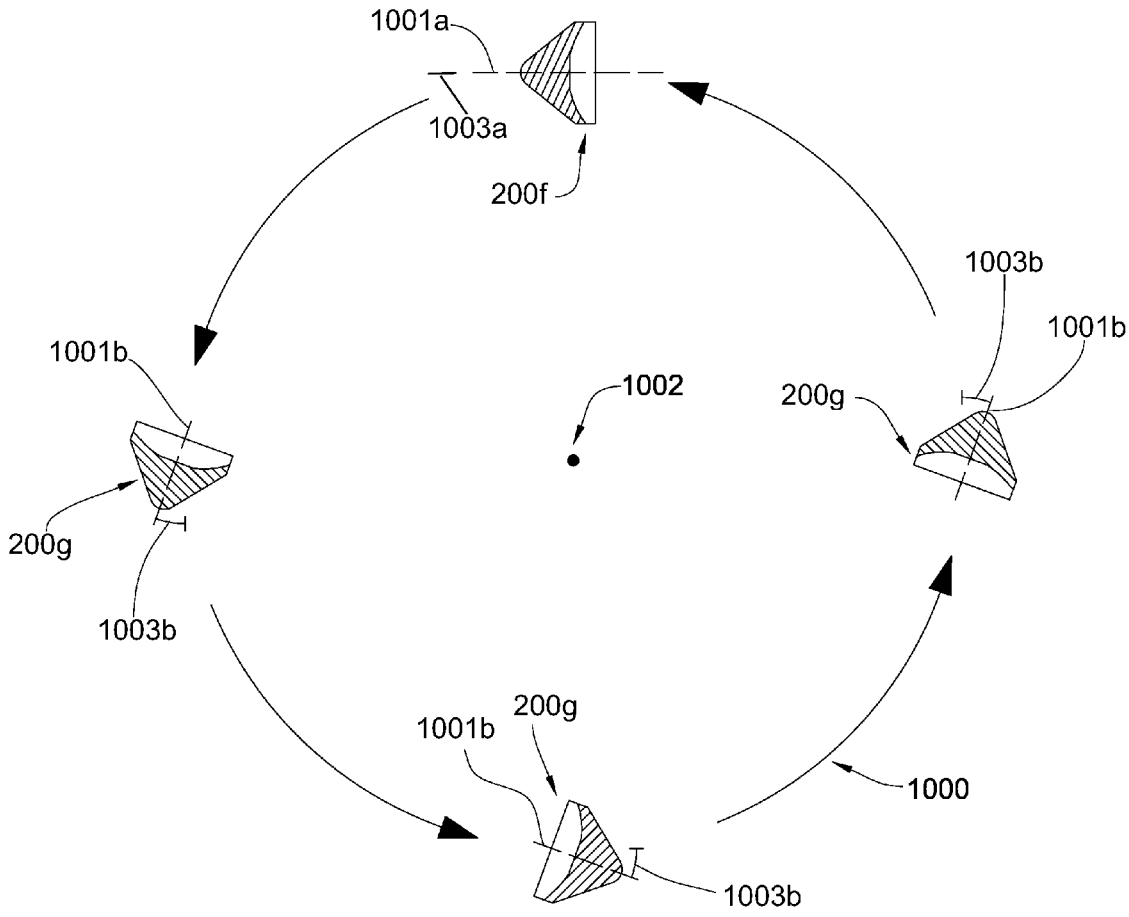
FIG. 10 is a cross-sectional view of a cutting path of several embodiments of a cutting element.

FIG. 10 is an orthogonal view of a cutting path 1000. A cutting element 200*f* comprises a central axis 1001*a* and rotates about a center of rotation 1002. Central axis 1001*a* may form a side rake angle 1003*a* with respect to a tangent line to the cutting path 1000 of substantially zero. In some embodiments, a cutting element 200*g* comprises a central axis 1001*b* that forms a side rake angle 1003*b* that is positive. In other embodiments a side rake angle may be substantially zero, positive, or negative.

Figure 11:
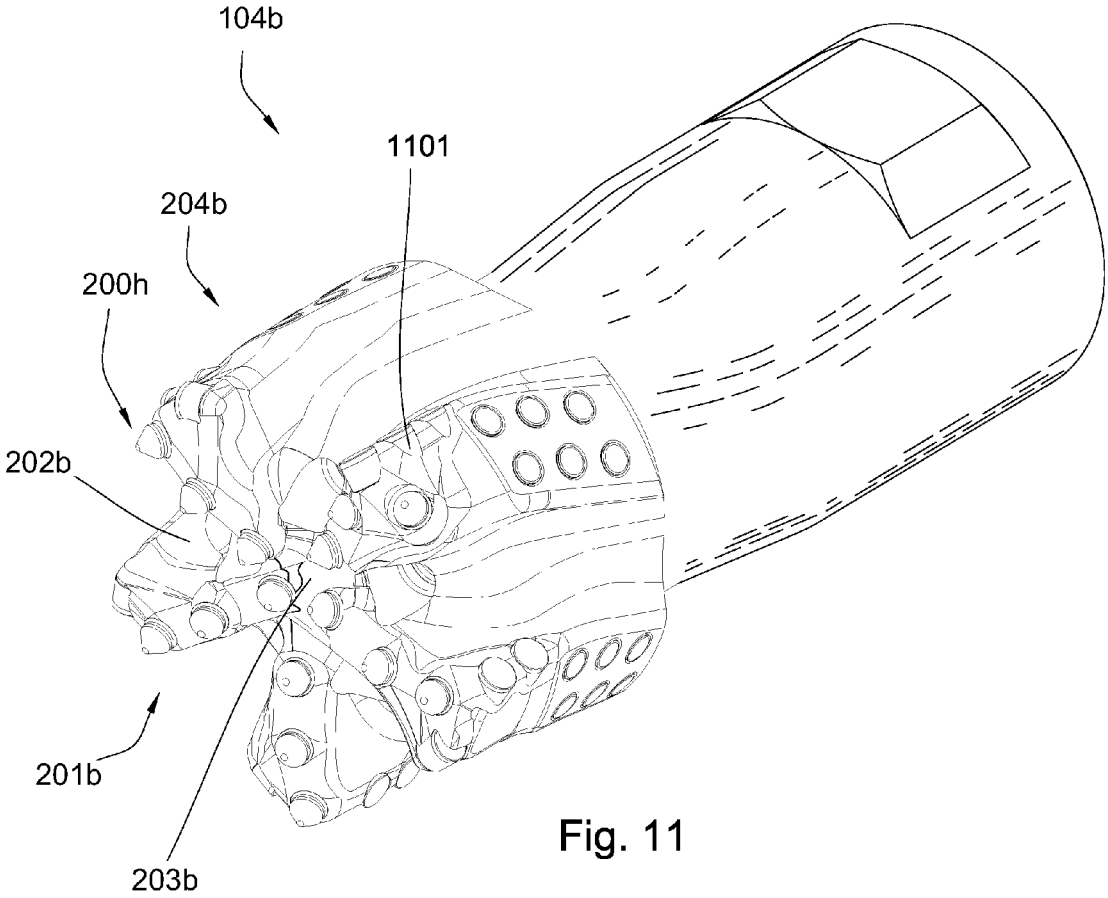
FIG. 11 is a perspective view of another embodiment of a drill bit.

FIG. 11 discloses another embodiment of a drill bit 104*c*. This embodiment comprises a plurality of substantially pointed cutting elements 200*h* affixed by brazing, press fit or another method to a plurality of radial blades 202*b*. Blades 202*b* converge toward a center 203*b* of a working surface 201*b* and diverge towards a gauge portion 204*b*. Cylindrical cutting elements 1101 are affixed to the blades 202*b* intermediate the working surface 201*b* and the gauge portion 204*b*.

Figure 12:
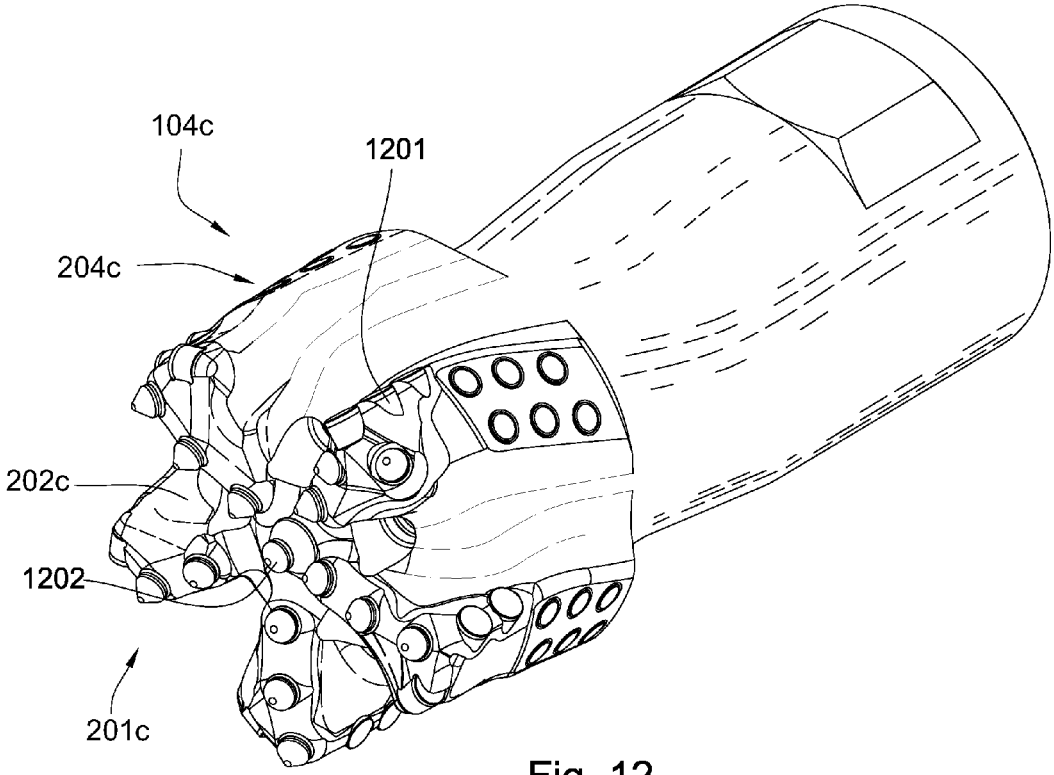
FIG. 12 is a perspective view of another embodiment of a drill bit.

FIG. 12 discloses another embodiment of a drill bit 104*c*. In this embodiment, cylindrical cutters 1201 are affixed to radial blades 202*c* intermediate a working surface 201*c* and a gauge portion 204*c*. Drill bit 104*c* also comprises an indenting member 1202.

Figure 13:
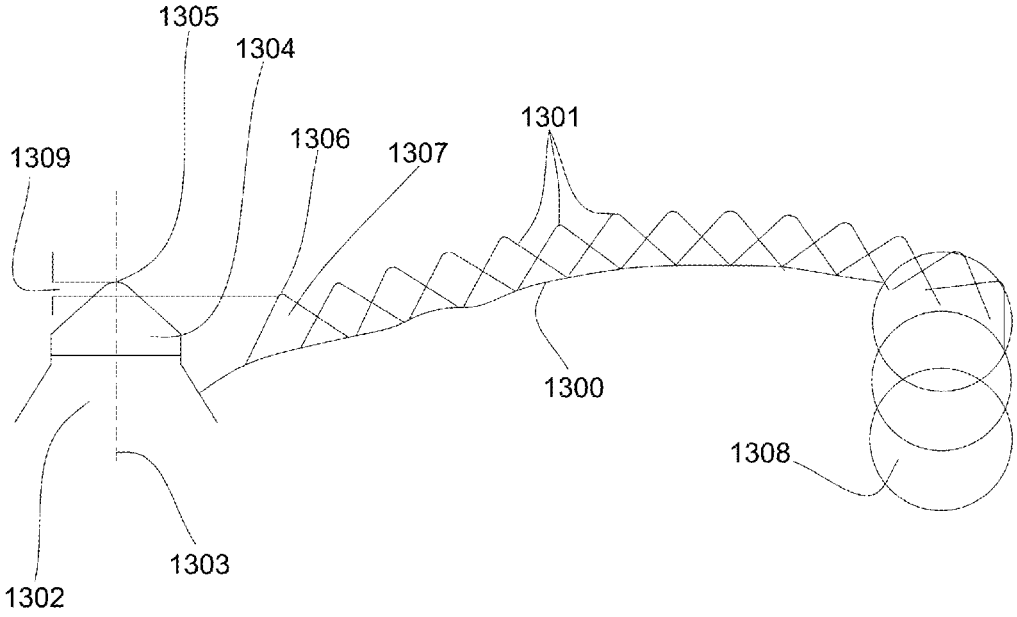
FIG. 13 is an orthogonal view of a cutting element profile of another embodiment of a drill bit.

FIG. 13 discloses another embodiment of a blade profile 1300. Blade profile 1300 comprises the superimposed profiles 1301 of cutting elements from a plurality of blades. In this embodiment, an indenting member 1302 is disposed at a central axis of rotation 1303 of the drill bit. Indenting member 1302 comprises a cutting element 1304 capable of bearing the weight-on-bit. An apex 1305 of the indenter cutting element 1304 protrudes a protruding distance 1309 beyond an apex 1306 of a most central cutting element 1307. Distance 1309 may be advantageously chosen to encourage oscillations in torque and WOB. Distance 1309 may be variable by moving the indenting member 1302 axially along rotational axis 1303, or the indenting member 1302 may be rigidly fixed to the drill bit. The distance 1309 in some embodiments may not extend to the apex 1306 of the most central cutting element 1307. Cylindrical shear cutters 1308 may be disposed on a gauge portion of the blade profile 1300.

Figure 14:
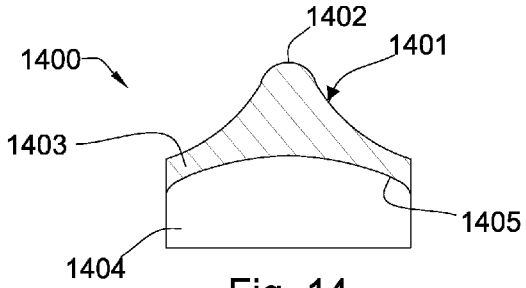
FIG. 14 is a cross-sectional view of another embodiment of a cutting element

FIG. 14 discloses an embodiment of a substantially pointed cutting element 1400. Cutting element 1400 comprises a superhard material portion 1403 with a substantially concave pointed portion 1401 and an apex 1402. Superhard material portion 1403 is bonded to a cemented metal carbide portion 1404 at a non-planer interface 1405.

Figure 15:
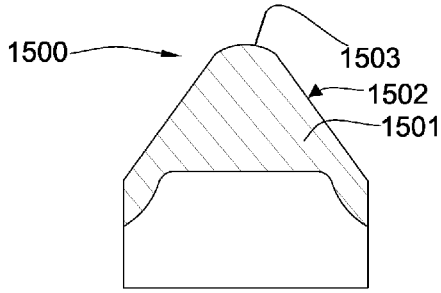
FIG. 15 is a cross-sectional view of another embodiment of a cutting element.

FIG. 15 discloses another embodiment of a substantially pointed cutting element 1500. A superhard material portion 1501 comprises a linear tapered pointed portion 1502 and an apex 1503.

Figure 16:
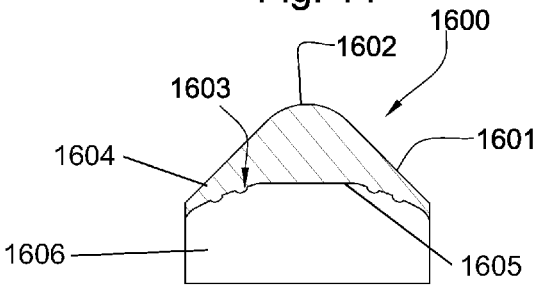
FIG. 16 is a cross-sectional view of another embodiment of a cutting element.

FIG. 16 discloses another embodiment of a substantially pointed cutting element 1600. Cutting element 1600 comprises a linear tapered pointed portion 1601 and an apex 1602. A non-planer interface 1605 between a superhard material portion 1604 and a cemented metal carbide portion 1606 comprises notches 1603.

Figure 17:
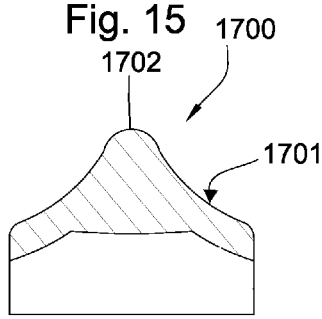
FIG. 17 is a cross-sectional view of another embodiment of a cutting element.

FIG. 17 discloses another embodiment of a substantially pointed cutting element 1700. Cutting element 1700 comprises a substantially concave pointed portion 1701 and an apex 1702.

Figure 18:
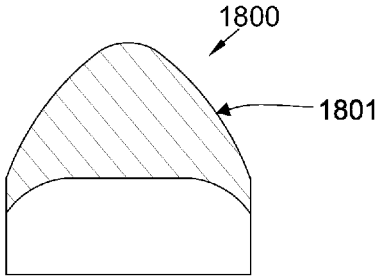
FIG. 18 is a cross-sectional view of another embodiment of a cutting element.

FIG. 18 discloses another embodiment of substantially pointed cutting element 1800. Cutting element 1800 comprises a substantially convex pointed portion 1801.

Figure 19:
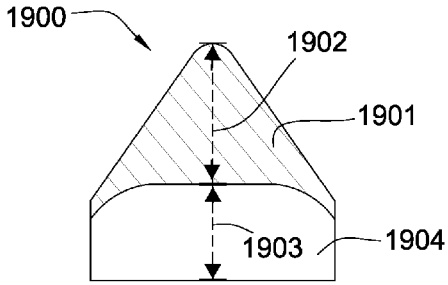
FIG. 19 is a cross-sectional view of another embodiment of a cutting element.

FIG. 19 discloses another embodiment of a substantially pointed cutting element 1900. A superhard material portion 1901 comprises a height 1902 greater than a height 1903 of a cemented metal carbide portion 1904.

Figure 20:
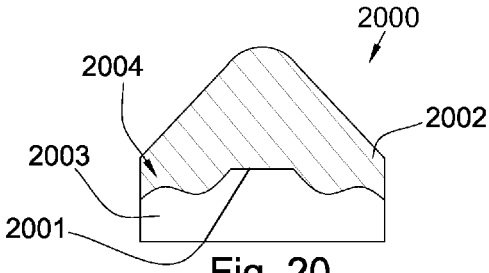
FIG. 20 is a cross-sectional view of another embodiment of a cutting element.

FIG. 20 discloses another embodiment of a substantially pointed cutting element 2000. In this embodiment, a non-planer interface 2001 intermediate a superhard material portion 2002 and a cemented metal carbide portion 2003 comprises a spline curve profile 2004.

Figure 21:
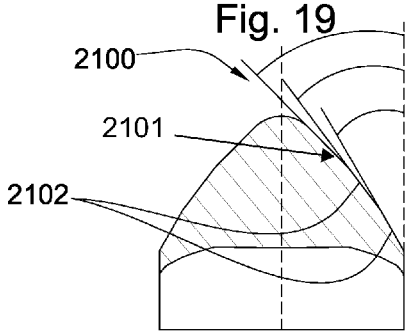
FIG. 21 is a cross-sectional view of another embodiment of a cutting element.

FIG. 21 comprises another embodiment of a substantially pointed cutting element 2100 comprising a pointed portion 2101 with a plurality of linear tapered portions 2102.

Figure 22:
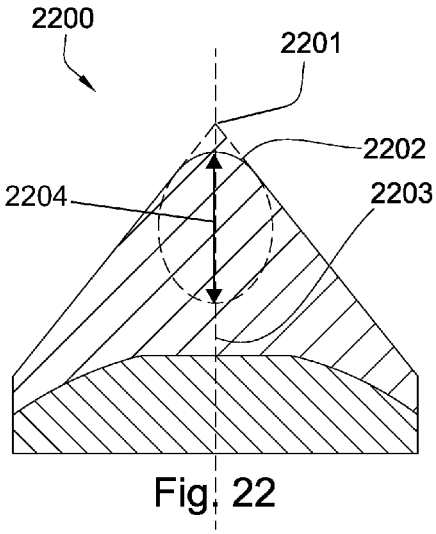
FIG. 22 is a cross-sectional view of another embodiment of a cutting element.

FIG. 22 discloses another embodiment of a substantially pointed cutting element 2200. In this embodiment, an apex 2201 comprises substantially elliptical geometry 2202. The ellipse may comprise major and minor axes that may be aligned with a central axis 2203 of the cutting element 2200. In this embodiment, the major axis 2204 is aligned with the central axis 2203.

Figure 23:
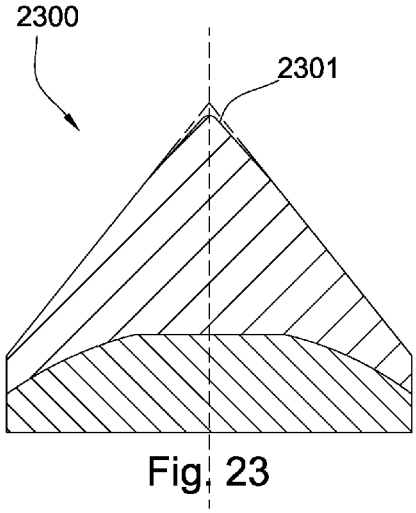
FIG. 23 is a cross-sectional view of another embodiment of a cutting element.

FIG. 23 discloses another embodiment of a substantially pointed cutting element 2300. In this embodiment, an apex 2301 comprises substantially hyperbolic geometry.

Figure 24:
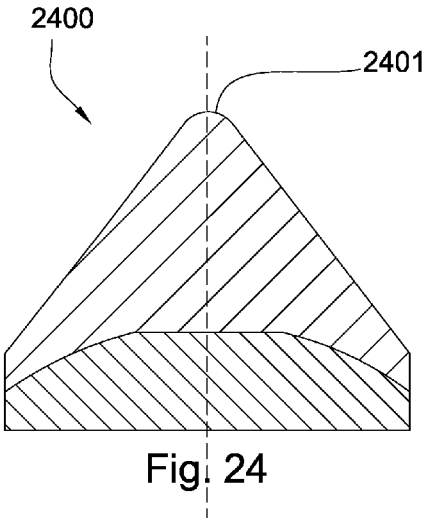
FIG. 24 is a cross-sectional view of another embodiment of a cutting element.

FIG. 24 discloses another embodiment of a substantially pointed cutting element 2400. An apex 2401 comprises substantially parabolic geometry.

Figure 25:
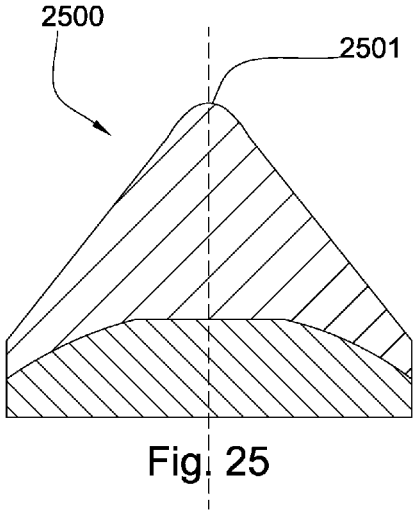
FIG. 25 is a cross-sectional view of another embodiment of a cutting element.

FIG. 25 discloses another embodiment of a substantially pointed cutting element 2500. An apex 2501 comprises a curve defined by a catenary. A catenary curve is believed to be the strongest curve in direct compression, and may improve the ability of the cutting element to withstand compressive forces.

Figure 26:
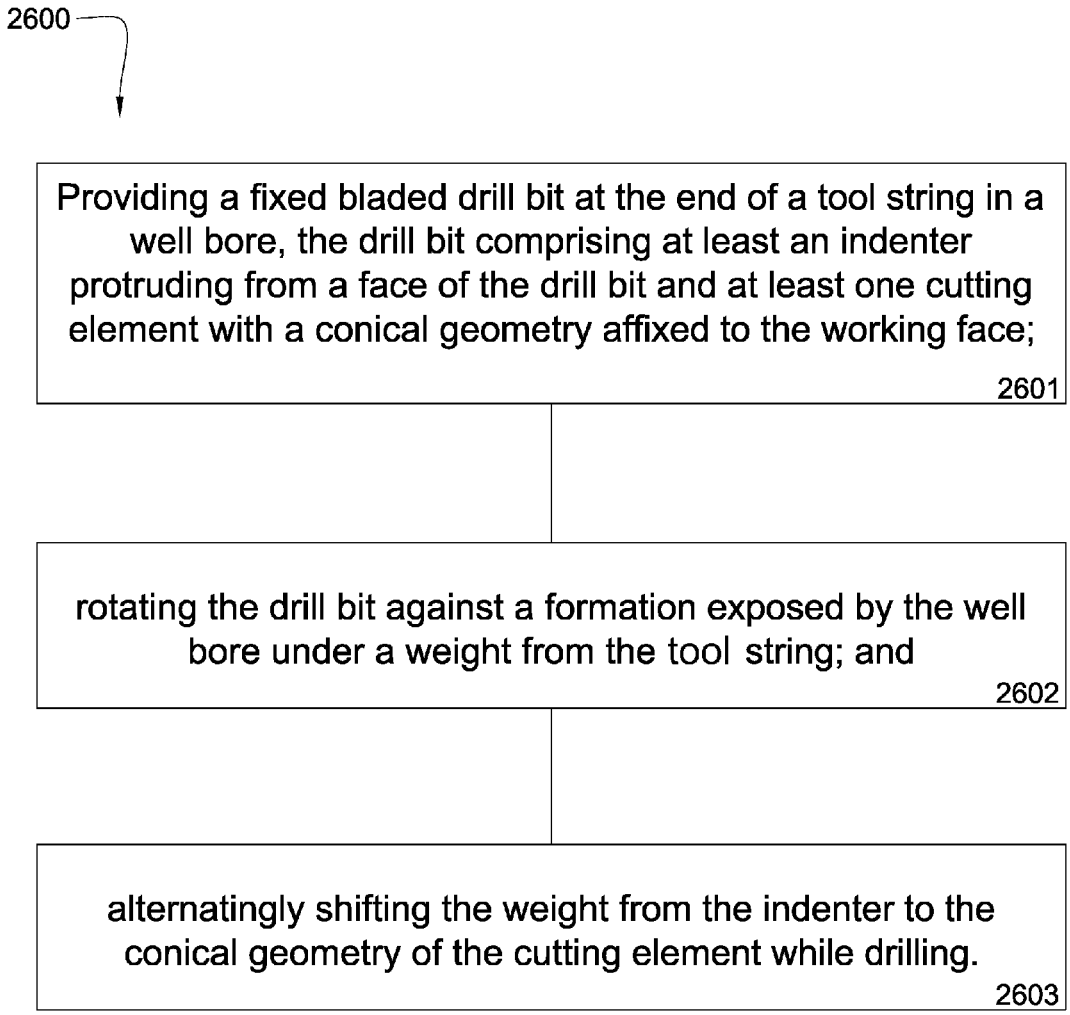
FIG. 26 is a diagram of an embodiment of a method of drilling a well bore.

FIG. 26 is a method 2600 of drilling a wellbore, comprising the steps of providing 2601 a fixed bladed drill bit at the end of a tool string in a wellbore, the drill bit comprising at least one indenter protruding from a face of the drill bit and at least one cutting element with a pointed geometry affixed to the working face, rotating 2602 the drill bit against a formation exposed by the wellbore under a weight from the tool string, and alternately 2603 shifting the weight from the indenter to the pointed geometry of the cutting element while drilling.

Figure 27:
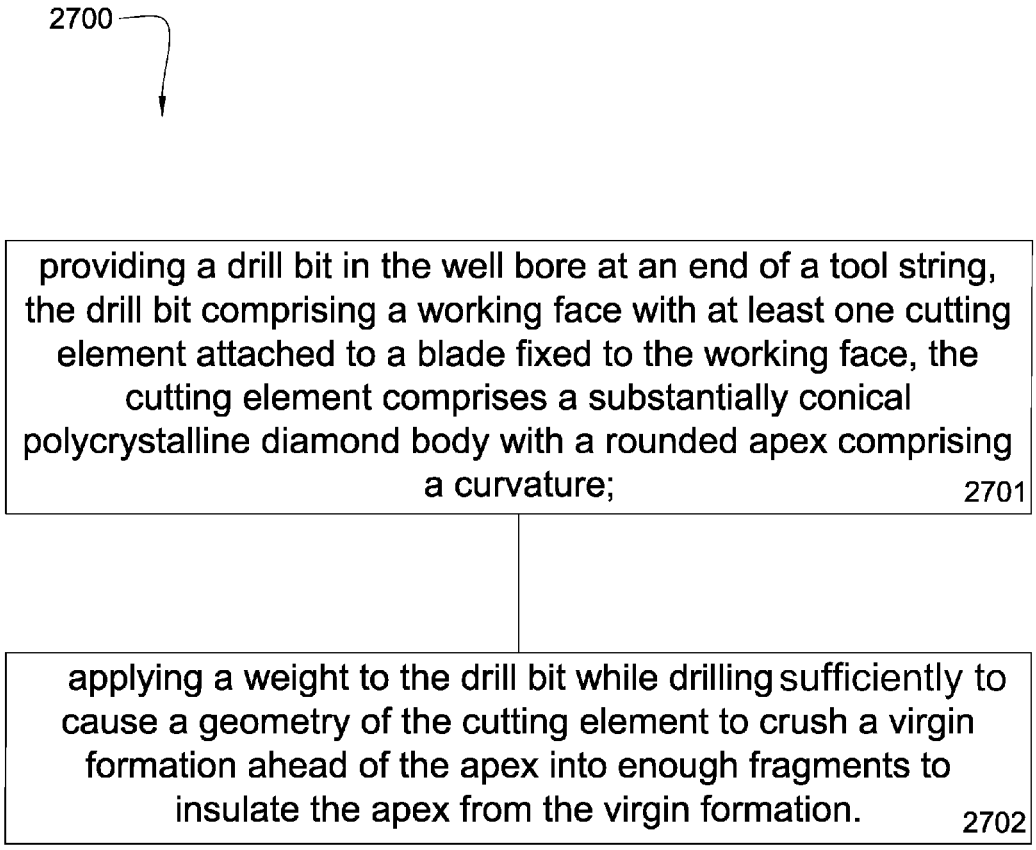
FIG. 27 is a diagram of another embodiment of a method of drilling a well bore.

FIG. 27 is a method 2700 for drilling a wellbore, comprising the steps of providing 2701 a drill bit in a wellbore at an end of a tool string, the drill bit comprising a working face with at least one cutting element attached to a blade fixed to the working face, the cutting element comprising a substantially pointed polycrystalline diamond body with a rounded apex comprising a curvature, and applying 2702 a weight to the drill bit while drilling sufficiently to cause a geometry of the cutting element to crush a virgin formation ahead of the apex into enough fragments to insulate the apex from the virgin formation.

The step of applying weight 2702 to the drill bit may include applying a weight that is over 20,000 pounds. The step of applying weight 2702 may include applying a torque to the drill bit. The step of applying weight 2702 may force the substantially pointed polycrystalline diamond body to indent the formation by at least 0.050 inches.

Whereas the present invention has been described in particular relation to the drawings attached hereto, it should be understood that other and further modifications apart from those shown or suggested herein, may be made within the scope and spirit of the present invention.

What is claimed is:

1. A fixed bladed bit for drilling underground into a formation, the fixed bladed bit comprising:

a shank;

a bit body attached to the shank, the bit body having a working surface that includes at least one blade for engaging the formation, the at least one blade extending away from the working surface;

at least one cutting element attached to the at least one blade, the cutting element including:

a superhard material that includes:

a central axis;

a side wall;

an apex at which the side wall intersects to form an included angle;

the side wall and the apex forming a substantially pointed geometry that in cross-section includes a diameter between a transition where a curvature of the apex tangentially meets the side wall, the curvature being bounded within the side wall; and, a cemented metal carbide substrate bonded to the superhard material at a non-planar interface.

2. The fixed bladed bit of claim 1, wherein the cutting element is positioned at a positive rake angle, where rake angle is defined as the angle formed between the central axis of the cutting element and a line parallel with a bit axis.

3. The fixed bladed bit of claim 2, wherein the positive rake angle is between 5 degrees to 20 degrees.

4. The fixed bladed bit of claim 2, wherein a leading portion of one of the first side wall and the second side wall is positioned at a negative rake angle.

5. The fixed bladed bit of claim 1, wherein the cutting element is positioned on at least one of a flank and a gauge of the at least one blade.

6. The fixed bladed bit of claim 1, where the included angle is between 75 degrees and 90 degrees.

7. The fixed bladed bit of claim 1, wherein the superhard material is sintered polycrystalline diamond.

8. The fixed bladed bit of claim 7, wherein the sintered polycrystalline diamond comprises a volume with less than 5 percent catalyst metal concentration and 95 percent of a plurality of interstices in the sintered polycrystalline diamond comprise a catalyst.

9. The fixed bladed bit of claim 1, wherein the non-planar interface comprises an elevated flatted region that connects to a cylindrical portion of the cemented metal carbide substrate by a tapered section.

10. The fixed bladed bit of claim 1, wherein the diameter is less than one-third of a diameter of the cemented metal carbide substrate.

11. The fixed bladed bit of claim 10, wherein the diameter is less than one-quarter of the diameter of the cemented metal carbide substrate.

12. The fixed bladed bit of claim 1, wherein the curvature is a radius of curvature.

13. The fixed bladed bit of claim 12, wherein the radius of curvature is less than 0.120 inches.

14. The fixed bladed bit of claim 13, wherein the radius of curvature is between 0.050 inches and 0.120 inches.

15. The fixed bladed bit of claim 1, wherein the curvature is defined by a portion of at least one of an ellipse, a parabola, a hyperbola, a catenary, and a parametric spline.

16. The fixed bladed bit of claim 4, wherein the positive rake angle is less than one-half the included angle.

17. The fixed bladed bit of claim 1, wherein the non-planar interface includes at least one of notches and a spline curve profile.

18. The fixed bladed bit of claim 1, wherein the side wall includes at least one of a linear tapered portion, a concave portion, and a convex portion.

19. The fixed bladed bit of claim 1, wherein the superhard material comprises a height greater than a height of the cemented metal carbide substrate.

20. The fixed bladed bit of claim 1, further comprising a plurality of blades extending away from the working surface of the bit body and an indenting member that extends a distance from the working surface of the bit body between the plurality of blades.

* * * * *

UNITED STATES PATENT AND TRADEMARK OFFICE

CERTIFICATE OF CORRECTION

PATENT NO. : 8,567,532 B2
APPLICATION NO. : 12/619305
DATED : October 29, 2013
INVENTOR(S) : David R. Hall et al.

It is certified that error appears in the above-identified patent and that said Letters Patent is hereby corrected as shown below:

On the title page, lines 4-8 of item 63, Related U.S. Application Data, "filed on Jul. 3, 2007, now Pat. No. 7,997,661, which is a continuation-in-part of application No. 11/766,975, filed on Jun. 22, 2007, now Pat. No. 8,122,980, which is a continuation-in-part of application No. 11/766,903, filed on Jun. 22, 2007, which is a" should read:

-- filed on Jul. 3, 2007, now Pat. No. 7,997,661, which is a continuation-in-part of application No. 11/766,903, filed on Jun. 22, 2007, which is a --

On the title page, lines 14-22 of item 63, Related U.S. Application Data, "on Apr. 30, 2007, now Pat. No. 7,469,971, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770, which is a continuation-in-part of application No. 11/673,634, filed on Feb. 12, 2007, now Pat. No. 8,109,349, which is a continuation-in-part of application No. 11/464,008, filed on Aug. 11, 2006," should read:

-- "on Apr. 30, 2007, now Pat. No. 7,469,971, which is a continuation-in-part of application No. 11/464,008, filed on Aug. 11, 2006," --

On the title page, line 32 of item 63, Related U.S. Application Data "filed on Aug. 11, 2006, now Pat. No. 7,413,256." should read:

-- filed on Aug. 11, 2006, now Pat. No. 7,413,256. Continuation-in-part of application No. 11/766,975, filed on Jun. 22, 2007, now Pat. No. 8,122,980. Continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770. Continuation-in-part of application No. 11/673,634, filed on Feb. 12, 2007, now Pat. No. 8,109,349. --

Signed and Sealed this
Eighth Day of April, 2014

Michelle K. Lee

Michelle K. Lee
*Deputy Director of the United States Patent and Trademark Office*